US005816723A

United States Patent [19]

Takahashi et al.

[11] Patent Number: 5,816,723

[45] Date of Patent: Oct. 6, 1998

[54] ELECTRONIC APPARATUS CAPABLE OF FEEDING SHEETS FROM A FRONT SIDE, AND SHEET FEEDING DEVICE FOR USE THEREWITH

[75] Inventors: Seiji Takahashi, Yokohama; Osamu Asakura, Sagamihara; Masasumi Nagashima, Yokohama; Yoshiyuki Shimamura, Yokohama; Kenji Kawazoe, Yokohama; Kazuya Iwata, Yokohama; Yuji Kanome, Yokohama; Tetsuya Ishikawa, Yokohama; Takahiro Ohde, Yokohama, all of Japan

[73] Assignee: Canon Kabushiki Kaisha, Tokyo, Japan

[21] Appl. No.: 921,660

[22] Filed: Sep. 2, 1997

Related U.S. Application Data

[63] Continuation of Ser. No. 372,163, Jan. 12, 1995, abandoned.

[30] Foreign Application Priority Data

| | | | |
|---|---|---|---|
| Jan. 19, 1994 | [JP] | Japan | 6-004055 |
| Sep. 30, 1994 | [JP] | Japan | 6-261331 |
| Oct. 19, 1994 | [JP] | Japan | 6-280041 |
| Nov. 15, 1994 | [JP] | Japan | 6-280623 |
| Nov. 15, 1994 | [JP] | Japan | 6-280624 |

[51] Int. Cl.[6] ..... B41J 11/58

[52] U.S. Cl. ..... 400/624; 400/625

[58] Field of Search ..... 400/622, 621, 400/625, 630, 642; 271/3.1, 4, 145

[56] References Cited

U.S. PATENT DOCUMENTS

| | | | |
|---|---|---|---|
| 4,699,534 | 10/1987 | Asakura et al. . | |
| 5,219,155 | 6/1993 | Kanome . | |
| 5,672,019 | 9/1997 | Hirmatsu et al. | 400/624 |

*Primary Examiner*—John S. Hilten

*Attorney, Agent, or Firm*—Fitzpatrick, Cella, Harper & Scinto

[57] ABSTRACT

A display unit is provided so as to be rotatable with respect to a main body of an electronic apparatus. An inlet for manually inserting a sheet is provided in the vicinity of the center of rotation of the display unit, and a sheet feeding device capable of continuously feeding sheets is provided so as to be detachable with respect to the inlet. It is thereby possible to supply a sheet from the front side of the electronic apparatus.

25 Claims, 33 Drawing Sheets

ELECTRONIC APPARATUS CAPABLE OF FEEDING SHEETS FROM A FRONT SIDE, AND SHEET FEEDING DEVICE FOR USE THEREWITH

This application is a continuation of application Ser. No. 08/372,163, filed Jan. 12, 1995, now abandoned.

BACKGROUND OF THE INVENTION

1. Field of the Invention

This invention relates to an electronic apparatus, such as a word processor, a personal computer or the like.

2. Description of the Related Art

In some of conventional so-called laptop or notebook-size electronic apparatuses, such as word processors, personal computers or the like, in which a display unit for displaying an image using a liquid crystal or the like is provided so as to be openable/closable with respect to the main body of the apparatus by rotating, a recording unit for recording the image displayed on the display unit is incorporated in the apparatus. The recording unit is generally disposed at the rear side of the main body of the apparatus. Accordingly, a sheet is supplied in a state in which the display unit is closed, or by the user going to the rear side of the apparatus. When continuously supplying sheets, a separate sheet feeding device (an automatic sheet feeding device (ASF)) is mounted on the electronic apparatus only when necessary, in order to make the apparatus compact.

In the above-described conventional approach, the display unit must be closed and opened, or the operator must stand up and go to the rear side of the apparatus, whenever supplying a sheet or mounting the sheet-feeding device, making operation of the apparatus cumbersome.

SUMMARY OF THE INVENTION

It is an object of the present invention to provide an electronic apparatus having an excellent operability by arranging the apparatus to allow the operator to supply a sheet from the front side of the apparatus.

According to one aspect, the present invention, which achieves the above-described object, relates to an electronic apparatus having an inlet for manually inserting a sheet in the vicinity of the rotational axis of a display unit rotatably provided with respect to a main body of the apparatus. The electronic apparatus includes a sheet feeding device, capable of continuously feeding sheets, provided so as to be detachable with respect to the inlet.

In one embodiment, the display unit makes a keyboard, provided in the main body of the apparatus, inoperable by covering the keyboard in a closed state, and makes the keyboard operable in an opened state. The sheet feeding device covers a portion of the keyboard when being mounted, and setting of feeding control of the sheet feeding device can be input through an uncovered portion of the keyboard.

According to the above-described configuration, the inlet is provided in the vicinity of the rotational axis of the display unit so that a sheet can be manually inserted from the front side of the apparatus. In addition, since the sheet feeding device can be mounted on the inlet, the sheet feeding device can be mounted from the front side of the apparatus. Accordingly, the operation of the apparatus and the sheet-feeding operation can be performed from the front side of the apparatus, thereby improving the operability of the apparatus.

While a portion of the keyboard is covered when mounting the sheet feeding device from the front side of the apparatus, setting of feeding control can be input through uncovered keys of the keyboard, thereby improving the operability of the apparatus.

According to another aspect, the present invention relates to a sheet feeding device, capable of continuously feeding sheets, provided so as to be detachable with respect to an inlet, provided in the vicinity of the rotational axis of a display unit which is rotatable with respect to a main body of an apparatus. The sheet feeding device includes sheet supporting means for supporting sheets, positioning means for positioning the sheets while regulating end portions of the sheets in the direction of the width, and feeding means obliquely disposed so as to generate a feeding force for feeding the sheets supported by the sheet supporting means in a direction of the positioning means and a feeding force for feeding the sheets toward the positioning means, and separation means for individually separating the sheets fed by the feeding means.

According to still another aspect, the present invention relates to a sheet feeding device, capable of continuously feeding sheets, provided so as to be detachable with respect to an inlet, provided in the vicinity of the rotational axis of a display unit provided so as to be rotatable with respect to a main body of an apparatus. The display unit includes conveying means for conveying a sheet manually inserted from the aperture and the sheets fed from the sheet feeding device. The sheet feeding device includes sheet supporting means for supporting sheets, positioning means for positioning the sheets while regulating end portions of the sheets in the direction of the width, feeding means obliquely disposed so as to generate a feeding force to feed the sheets supported by the sheet supporting means in a direction of the positioning means and a feeding force for feeding the sheets in a predetermined direction different from the direction of the positioning means, and control means for driving the feeding means until the trailing edge of a sheet fed by the feeding means passes through the feeding means even after the sheet has been conveyed by the conveying means.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

A preferred embodiment of the present invention will now be described in detail with reference to the drawings.

Figure 1:
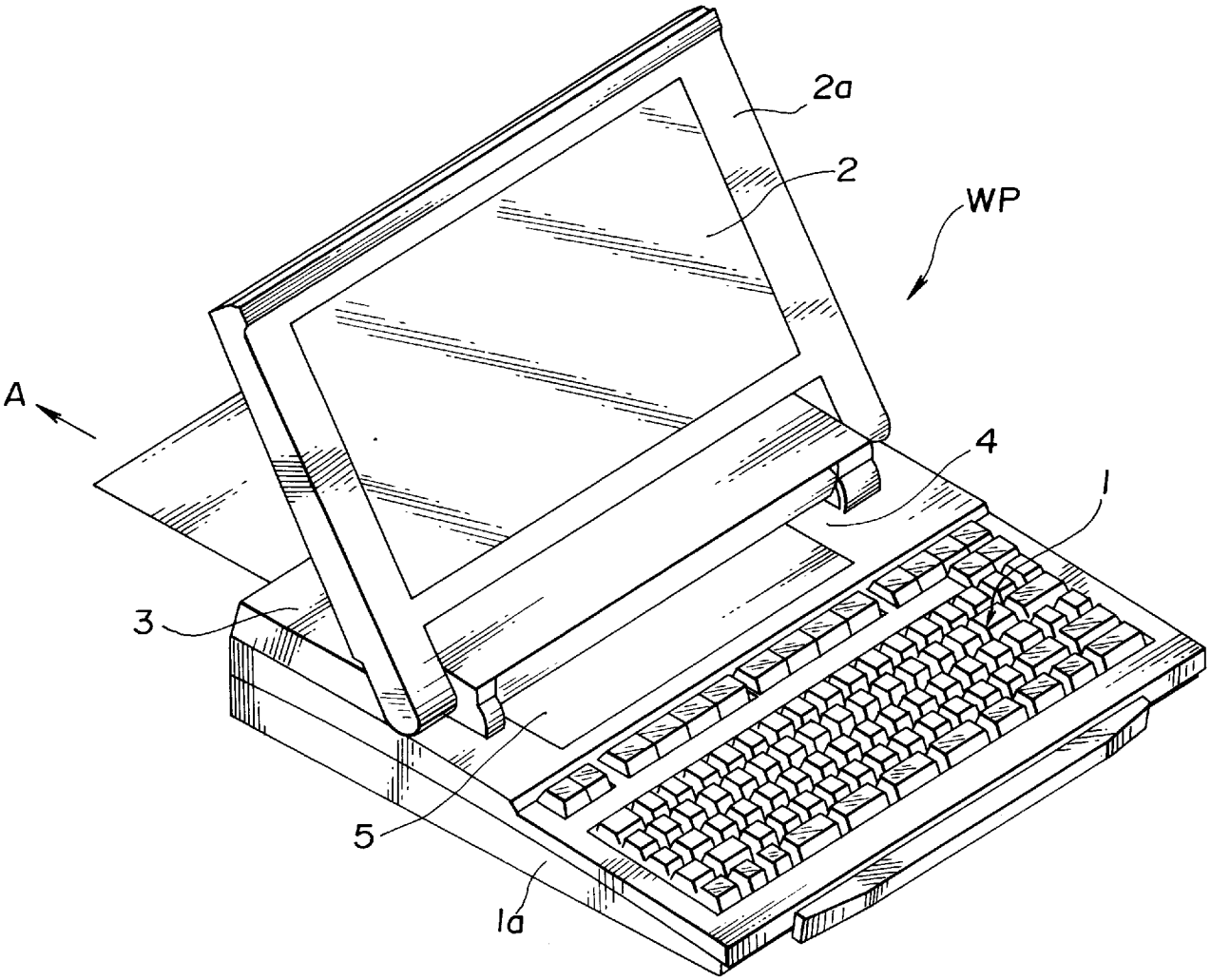
FIG. 1 is a perspective view of a word processor, serving as an electronic apparatus, according to an embodiment of the present invention.
Figure 2:
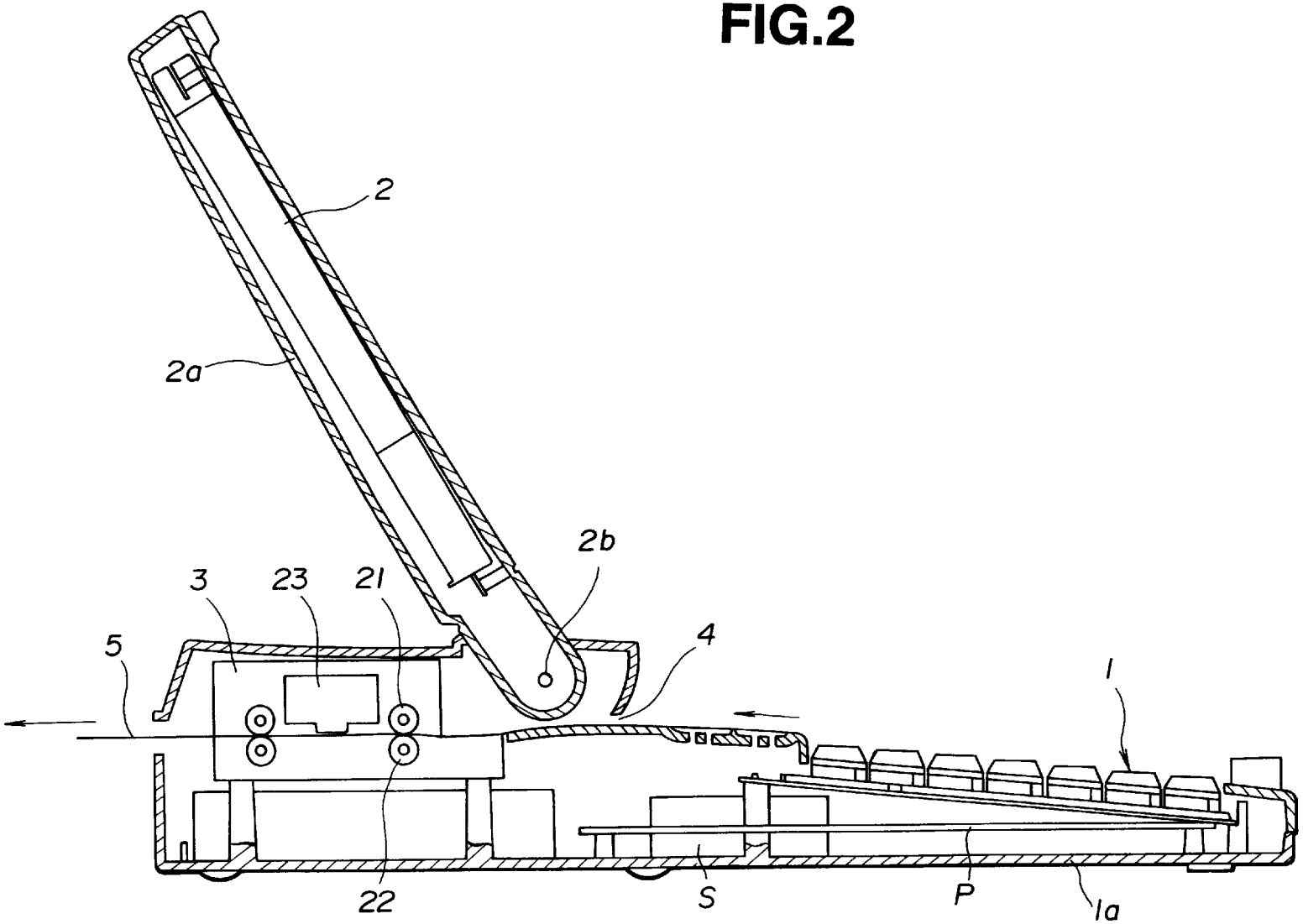
FIG. 2 is a vertical cross-sectional view of the word processor shown in FIG. 1.
Figure 3:
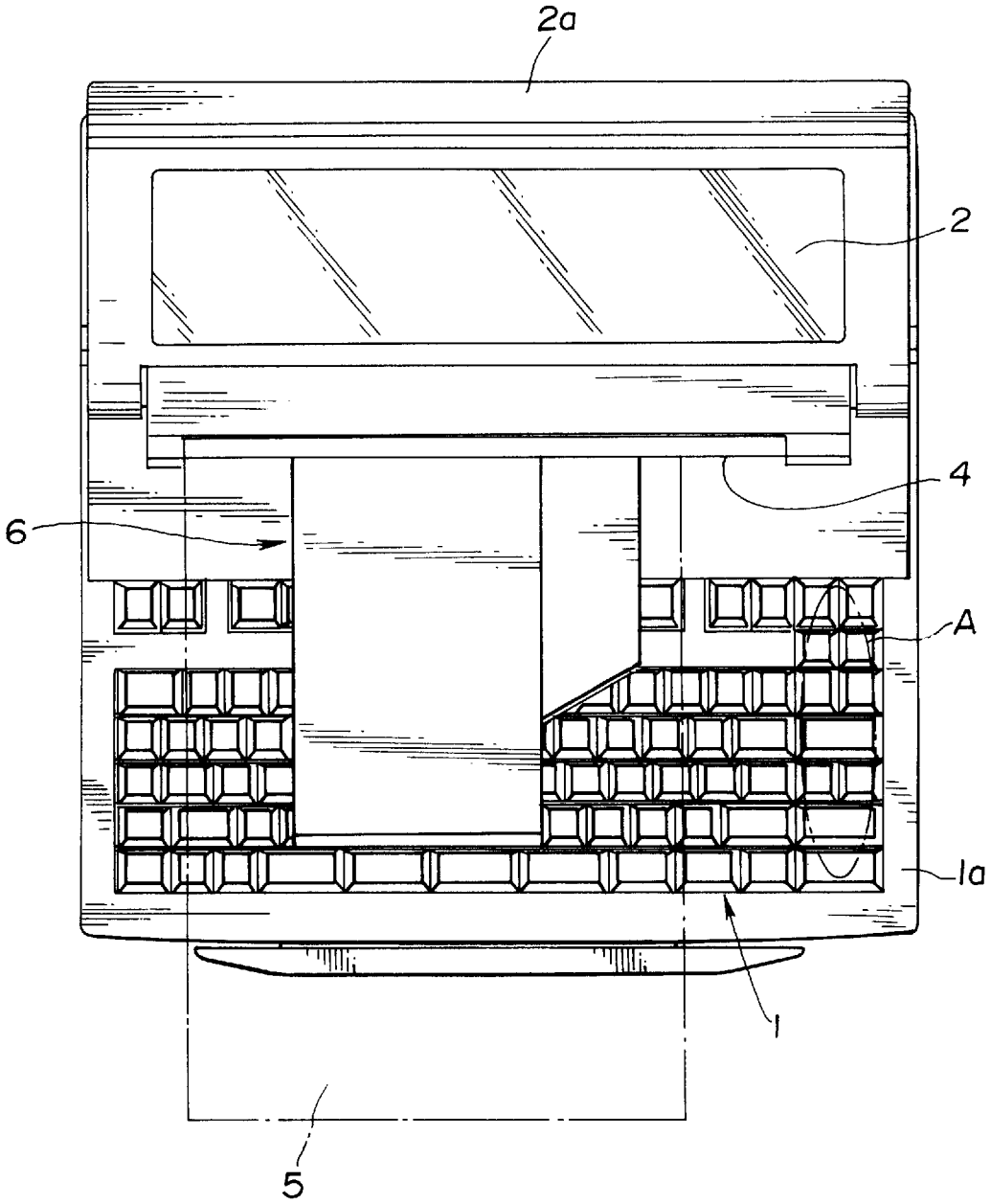
FIG. 3 is a plan view of the word processor shown in FIG. 1.
Figure 4:
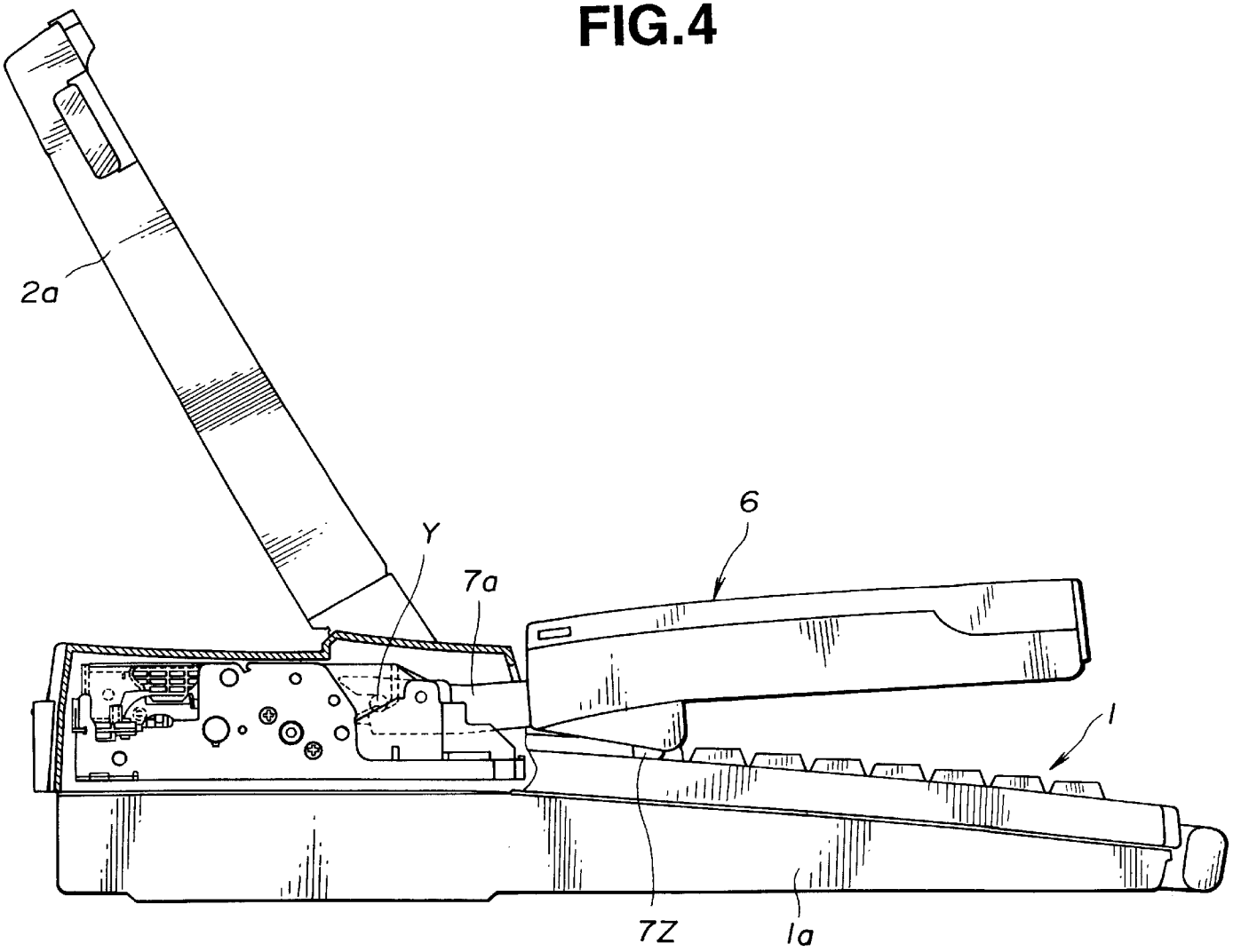
FIG. 4 is a partially cross-sectional side view illustrating a state in which a sheet feeding device is mounted on the word processor.
Figure 5:
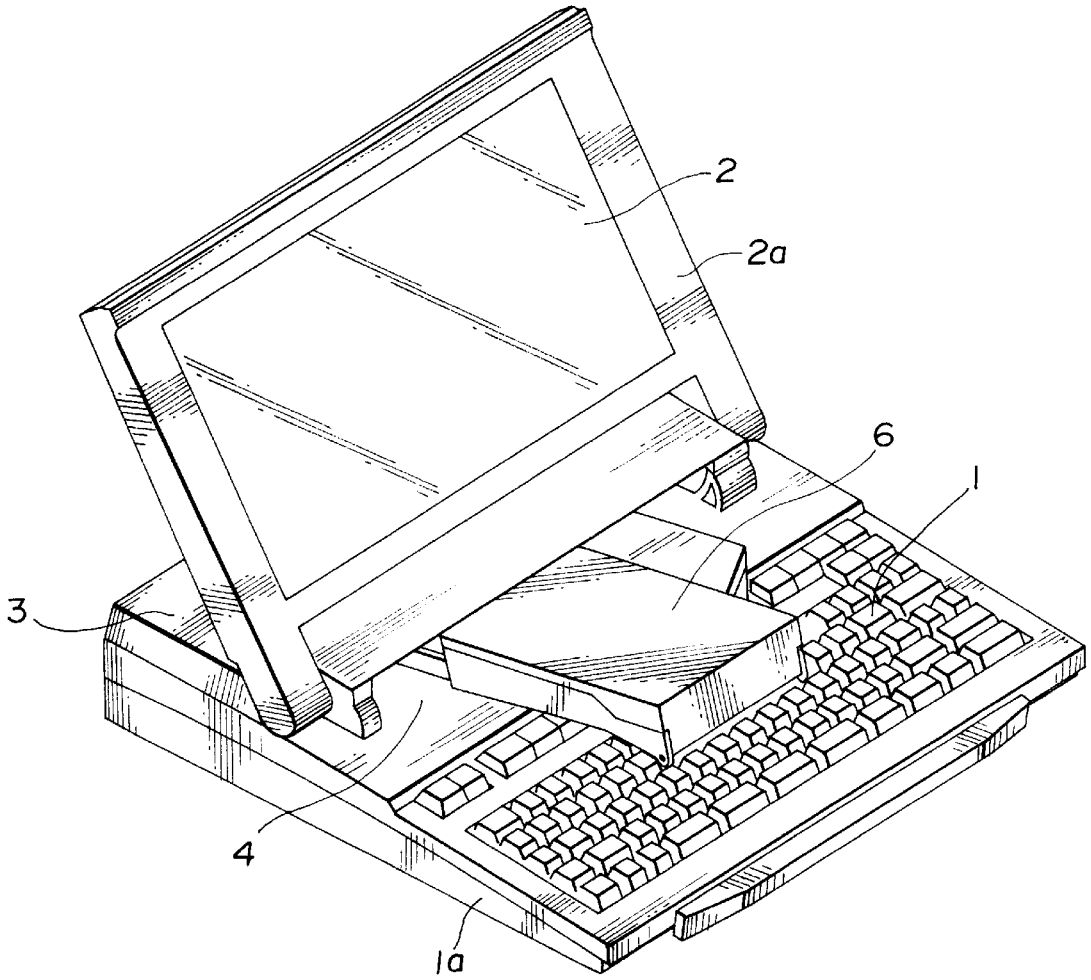
FIG. 5 is a perspective view illustrating the state in which the sheet feeding device is mounted on the word processor.

A description will be provided of the configuration of a word processor WP, serving as an electronic apparatus, to which the present invention is applied, with reference to FIGS. 1 through 5. FIG. 1 is an external perspective view of the word processor WP. FIG. 2 is a vertical cross-sectional view of the word processor WP shown in FIG. 1. FIGS. 3, 4 and 5 are a plan view, a side view and a perspective view of the word processor WP in a state in which a sheet feeding device (to be described later) is mounted thereon, respectively.

In FIGS. 1 and 2, there are shown a keyboard 1 for inputting information, a display unit 2, using a liquid crystal or the like, for displaying the information, a sheet processing unit 3 for recording the information on a fed sheet 5. In the present embodiment, the sheet processing unit 3 comprises a recording unit for recording the information on the sheet 5. Reference numeral 4 represents an inlet or aperture for inserting the sheet 5 into the recording unit 3. As shown in FIG. 1, when a sheet feeding device 6 (to be described later) is not mounted, the sheet 5 is manually inserted directly into recording unit 3 through the aperture 4.

The word processor WP is a so-called laptop type. In the word processor WP, a cover 2*a* including the display unit 2 is provided so as to be rotatable around a rotation shaft 2*b* relative to a main body 1*a* of the apparatus. As shown in FIG. 1, when the cover 2*a* is opened, the keyboard 1 can be operated. A power supply S, a substrate P and the like are incorporated within the main body 1*a*.

The aperture 4 is provided at the side of the main body 1*a*. When the cover 2*a* is opened, the aperture 4 is exposed to the outside, so that the sheet 5 can be inserted therein from the operational side of the keyboard 1. The recording unit 3 includes conveying rollers 21 and 22 for conveying the sheet 5 inserted from the aperture 4, and a recording head 23 for performing recording on the conveyed sheet 5. These units will be described in detail later on. After recording by the recording unit 3, the sheet 5 is discharged to a side opposite to the aperture 4 (the rear side of the main body 1*a*).

FIGS. 3 through 5 illustrate a state in which the sheet feeding device 6 is mounted on the word processor WP. The sheet feeding device 6 is mounted close to the center of the aperture 4. When manually inserting the sheet 5, the sheet 5 is inserted making the left end of the aperture 4 a reference position (as indicated by one-dot chain lines in FIG. 3). The sheet 5 fed from the sheet feeding device 6 has a reference position close to the center. Hence, a reference position for starting recording in the recording unit 3 differs between the manually fed sheet and the sheet fed from the sheet feeding device 6. When the sheet feeding device 6 is mounted, the mounting is detected by detection means (not shown), and the recording operation of the recording unit 3 is controlled based on the detection.

When the sheet feeding device 6 is mounted, a portion of the keyboard 1 is hidden by the sheet feeding device 6. However, since keys for setting recording conditions, such as the number of copies, printing conditions and the like, are arranged at a portion A shown in FIG. 3, the recording conditions can be input even after the sheet feeding device 6 has been mounted. Also when manually inserting a sheet, the keys in the portion A are used, so that recording conditions can be set by inputting through these keys after manually inserting the sheet.

As shown in FIGS. 4 and 5, the sheet feeding device 6 is mounted by causing recesses at distal ends of arms 7*a* (to be described later) to engage a mounting shaft Y provided on the main body 1*a*, and legs 7*z* to contact a horizontal surface in front of the aperture 4.

Sheet feeding device

Figure 6:
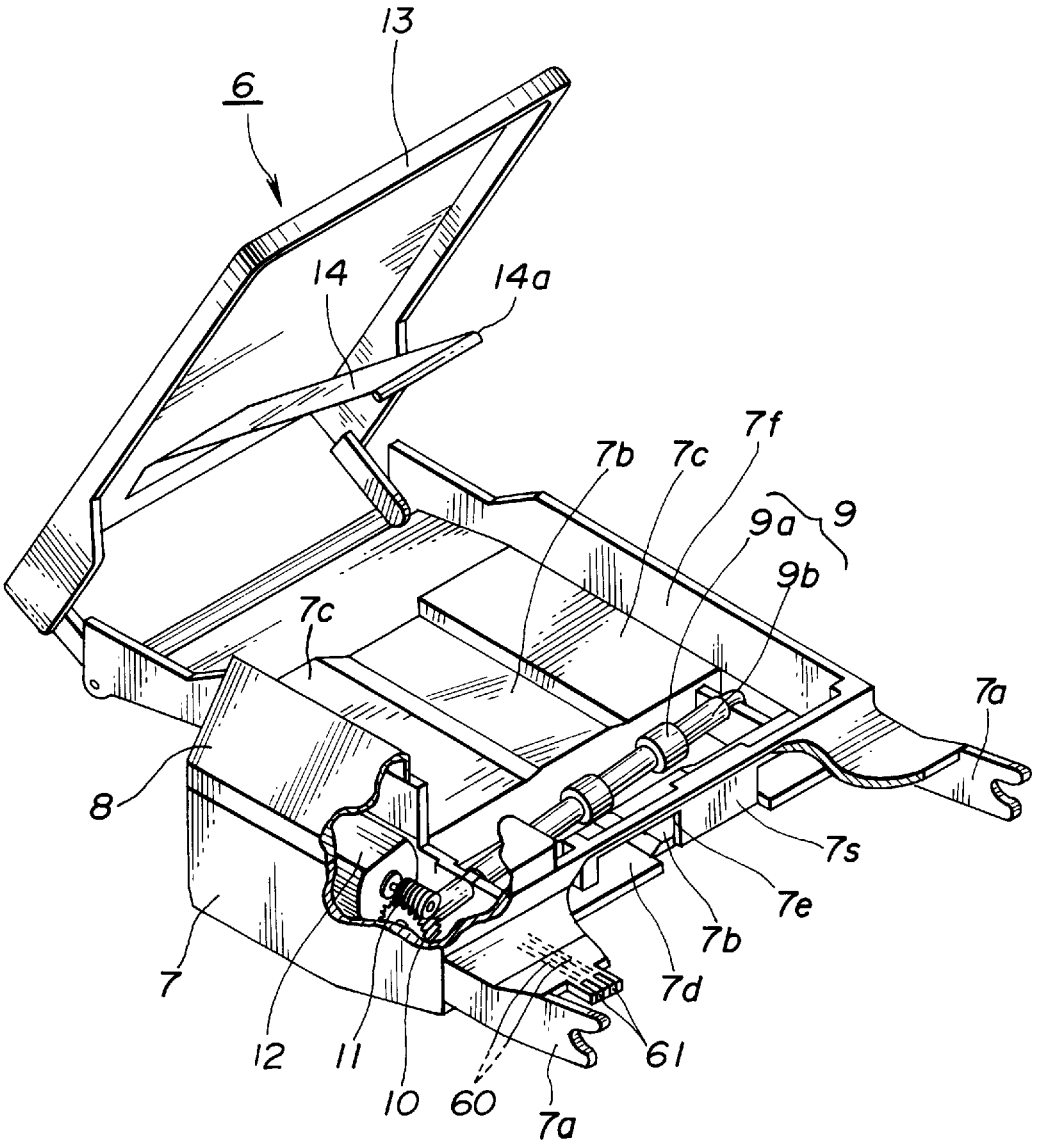
FIG. 6 is a perspective view illustrating an example of the sheet feeding device.

Next, a description will be provided of the configuration of the sheet feeding device 6 with reference to FIG. 6.

The sheet feeding device 6 includes a lower case 7, serving as sheet accommodating means S, an upper case 8 and an upper cover 13. The lower case 7 includes the arms 7*a* for connecting the sheet feeding device 6 to the recording unit 3 by engaging therewith, a reference surface (a central portion in the lateral direction) 7*b*, provided at a sheet accommodating surface, for accommodating and supporting sheets 5, and serving as reference height when mounting sheets, supporting surfaces (two side portions in the lateral direction) 7*c* whose height is more or less below that of the reference surface 7*b*, an aperture 7*d* for feeding a separated sheet 5, and an inclined portion 7*e*, serving as separation means for separating the sheets 5, all provided as one body. The reference surface 7*b* and the supporting surfaces 7*c* are connected with continuous inclined surfaces.

The upper case 8 covers a feeding motor 12, serving as a driving source, and a gear train. Reference numeral 9 represents a sheet feeding roller, serving as feeding means for feeding the sheet 5. A gear 10 is formed at one end of the sheet feeding roller 9 at the side of the feeding motor 12 as one body with the sheet feeding roller 9. The sheet feeding roller 9 includes a shaft 9*b* whose two end portions are supported on the lower case 7, and cylindrical roller units 9*a*, made of a hard rubber or the like, provided at two locations on the shaft 9*b* at a predetermined interval. In the present embodiment, the width of the roller units 9*a* is 8 mm, and the distance between the centers of the roller units 9*a* is 35 mm.

The height of the surface of the sheet feeding roller 9 in contact with the sheet 5 is equal to or higher than the reference surface 7*b*. A worm gear 11 is mounted on the feeding motor 12. In the present embodiment, a DC motor is used as the feeding motor 12.

Figure 7:
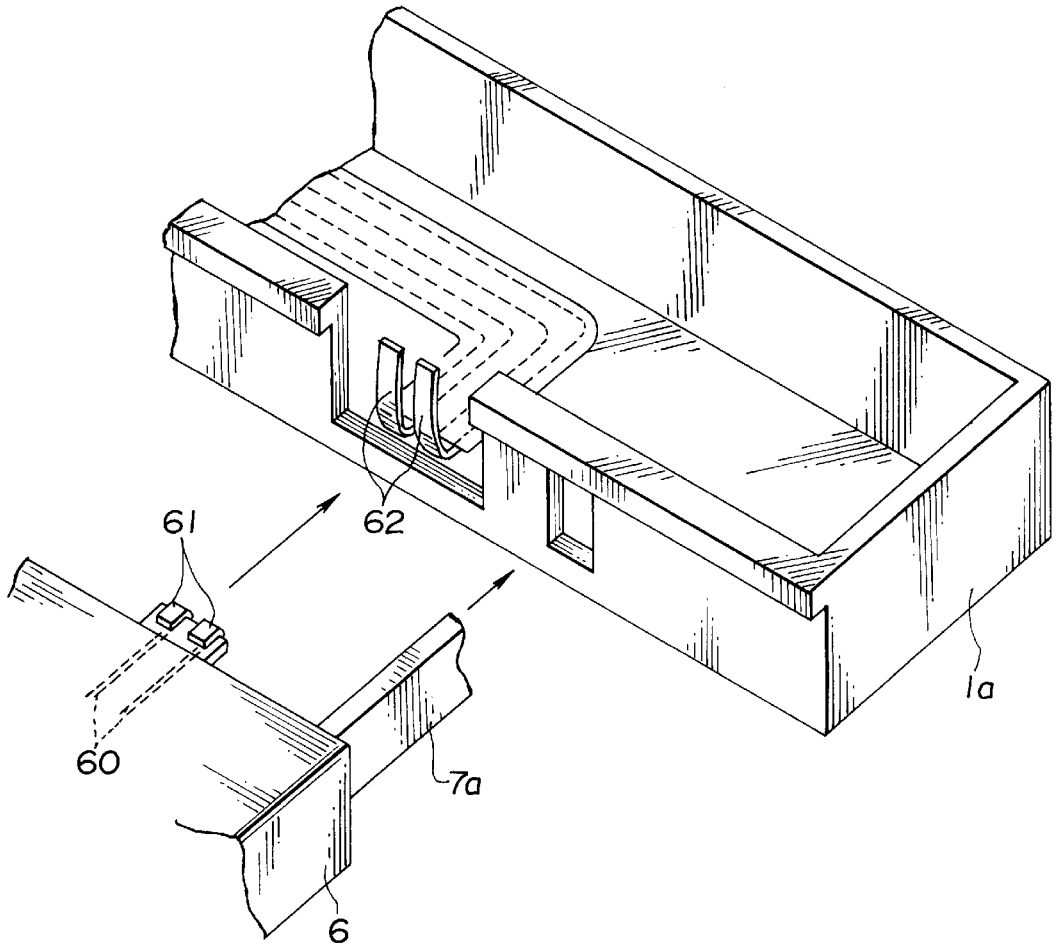
FIG. 7 is a perspective view illustrating electrical connection between the word processor and the sheet feeding device.

When the sheet feeding device 6 is mounted, electric power is supplied from the power supply S provided in the main body 1*a* of the word processor WP to the feeding motor 12. As shown in FIG. 7, metallic armatures 61 connected to the feeding motor 12 via cords 60 are provided at front-end portions of the sheet feeding device 6, and metallic armatures 62 connected to the power supply S via a CPU (central processing unit, to be described later, are provided at the main body 1*a* so as to face the metallic armatures 61. When the sheet feeding device 6 is mounted on the main body la, the metallic armatures 61 contact the metallic armatures 62, so that the sheet feeding device 6 is electrically connected to the main body la. The metallic armatures 62 provided at the main body 1*a* act as springs, so that the metallic armatures 61 and the metallic armatures 62 elastically contact.

Sheet-feeding control of the sheet feeding device 6 is performed by turning on/off electric power supply to the feeding motor 12 by a motor driver 35 of the CPU unit provided in the word processor WP. Accordingly, control means for performing sheet-feeding control is not provided at the sheet feeding device 6.

As shown in FIG. 6, a spring 14, serving as contact means for contacting the sheet 5 to the sheet feeding roller 9 is provided on the upper cover 13, so that the sheet 5 contacts the sheet feeding roller 9 by being pressed thereagainst. An end portion 14*a* of the spring 14 contacts the sheet 5. Although in the present embodiment, a leaf spring is used as the contact means, any other elastic member, such as a coil spring, a sponge, a piece of rubber or the like, may also be used.

Figure 8:
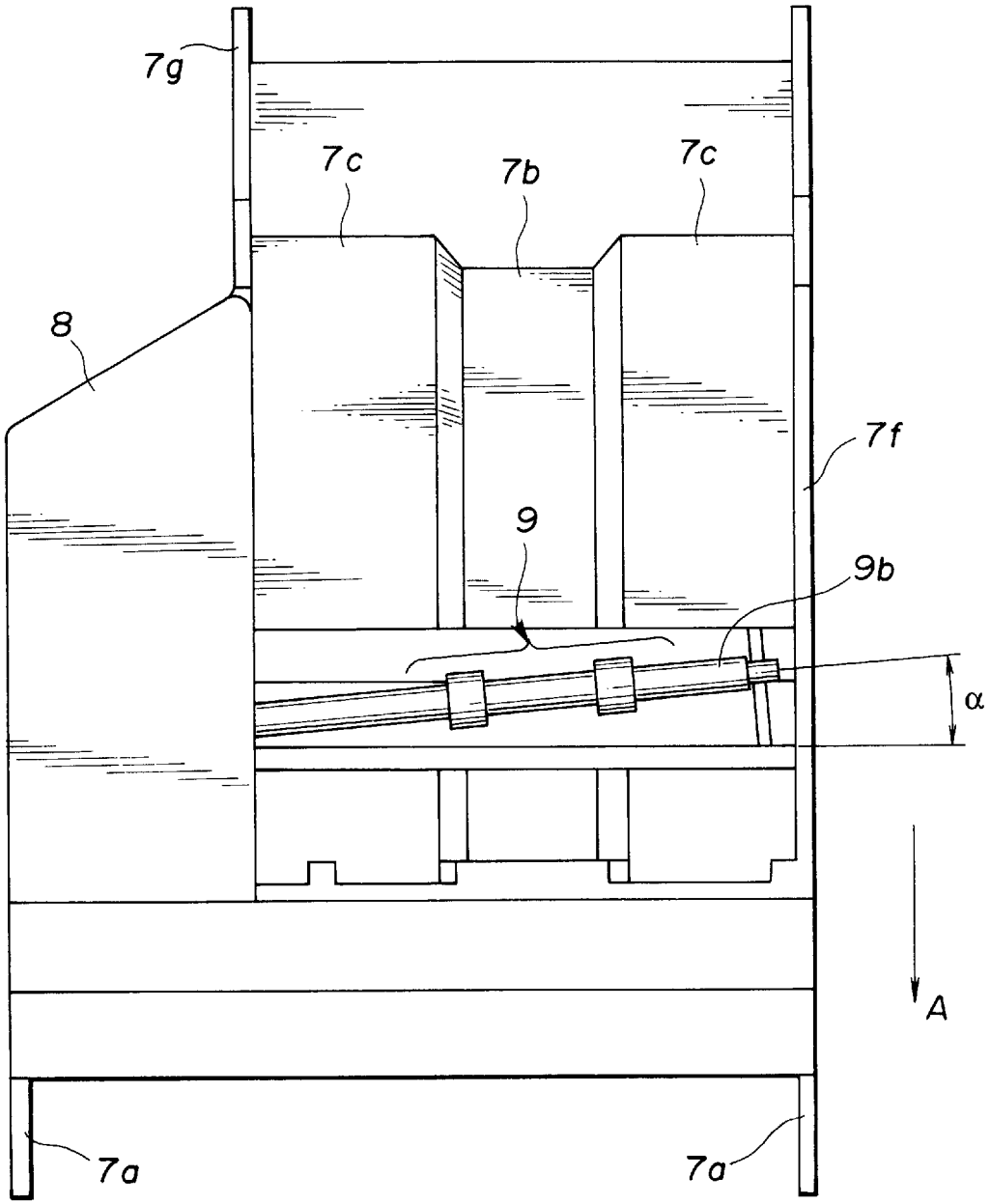
FIG. 8 is a plan view of the sheet feeding device.

FIG. 8 is a diagram illustrating the configuration of the sheet feeding device 6.

In FIG. 8, the sheet feeding roller 9 is disposed so as to have an angle $\alpha$ with respect to a direction orthogonal to the sheet feeding direction (a direction indicated by an arrow A) of the recording unit 3. Although in the present embodiment, the angle $\alpha$ is set to 5°, the angle is not limited to this value. Oblique movement can also be prevented by performing oblique-movement-preventing processing (to be described later), provided that the angle $\alpha$ is between the range of $0° < \alpha \leqq 45°$.

A front side wall 7*s* (see FIG. 6), side plates 7*f* and 7*g* are formed as one body on the lower case 7. The side plate 7*f* is formed so as to coincide with the recording reference position of the recording device 3, and functions as positioning means for positioning one side (one end portion in the direction of the width) of the sheets 5. The sheet 5 is fed so that the one side thereof moves along the side plate 7*f*. The side plate 7*g* is formed at a position having a certain amount of clearance with the ther side of the sheet 5 set along the side plate 7*f*. This is for facilitating setting of the sheet 5 on the lower case 7, and for accommodating variations in the size of sheets, and changes in the size of sheets due to changes in the ambient temperature and humidity. In the present embodiment, the clearance is set to 2 mm.

Figure 9:
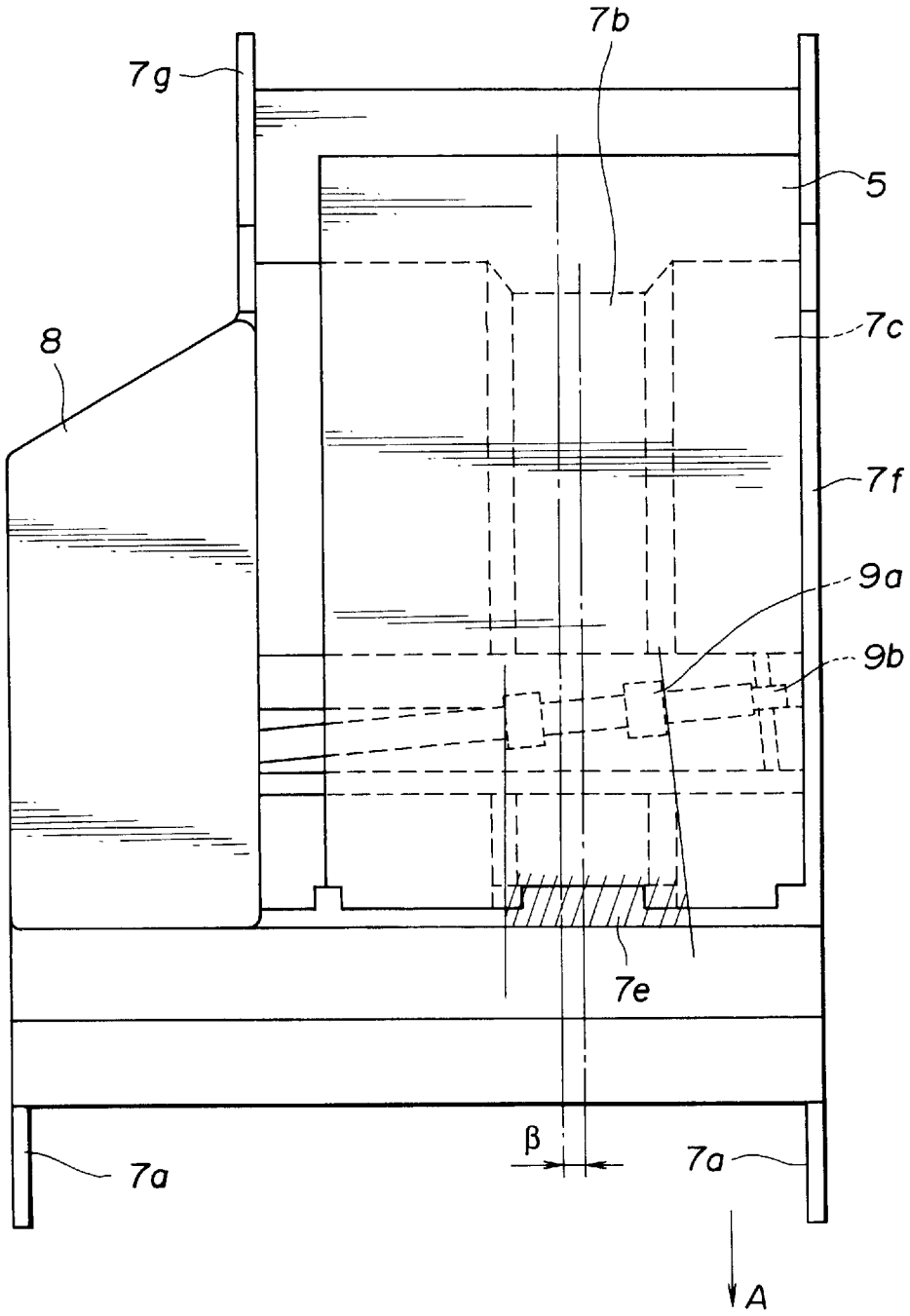
FIG. 9 is a plan view illustrating the positional relationship between members of the sheet feeding device.

FIG. 9 is a diagram illustrating the positional relationship among respective units of the sheet feeding device 6. As described above, the sheet feeding roller 9 comprises the two roller units 9*a* and the shaft 9*b*, and is disposed so that the center line between the two roller units 9*a* is shifted to a position closer to the reference side plate 7*f* by $\beta$ from the center position of the sheet 5 when the sheet 5 is aligned along the side plate 7*f*. The center of the reference surface 7*b* and the inclined portion 7*e* (see FIG. 12), serving as separation means, provided at the front side wall 7*s* is also situated at a position shifted to the side plate 7*f* by $\beta$, and is located at a substantially central portion when the sheet 5 is aligned along the side plate 7*f*. In FIG. 9, the contact position between the spring 14 shown in FIG. 6 and the sheet 5 is provided at a side upstream from the roller units 9*a* of the sheet feeding roller 9 in the sheet-feeding direction indicated by the arrow A, and at a position where the spring 14 does not contact the sheet feeding roller 9 when the sheet 5 is absent.

In the present embodiment, the inclined portion 7*e* for sheet separation is provided at the same position as the center of the roller units 9*a* in the lateral direction of the sheet 5. However, the inclined portion 7*e* may be provided at any other position, provided that as indicated by hatching, a portion of the sloped portion 7*e* is present within a range of extension of the position pressed by the spring 14 in the sheet-feeding direction or in a direction orthogonal to the sheet feeding roller 9. If the abovedescribed distance $\beta$ is set within the range of $0 \leqq \beta \leqq W/4$, where W is the width of the sheet 5, oblique movement of the sheet 5 can be prevented by performing oblique-movement-preventing processing (to be described below).

Processing to prevent oblique movement of the sheet

Figure 10:
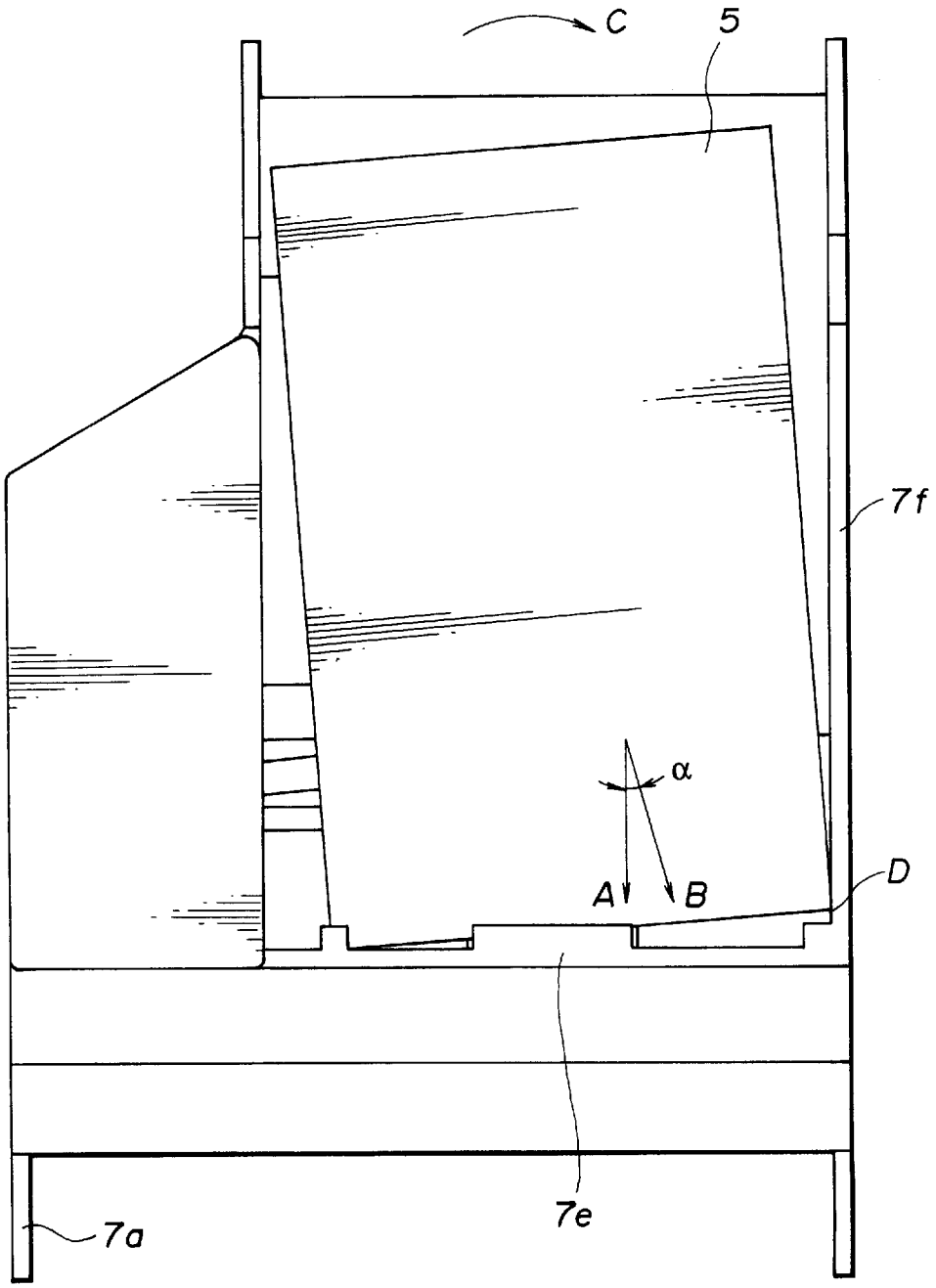
FIG. 10 is a plan view illustrating a state of the sheet feeding device before feeding a sheet.
Figure 11:
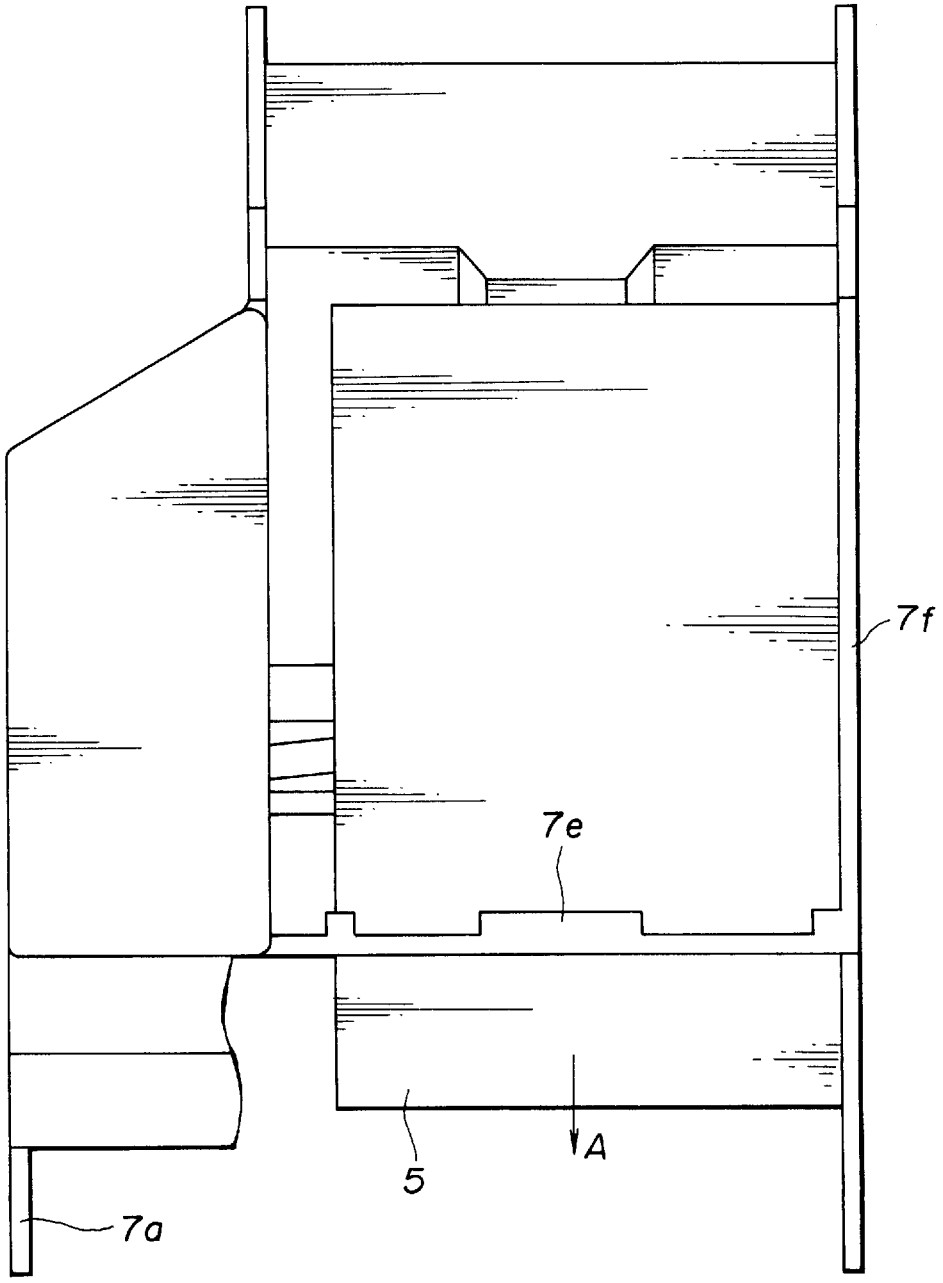
FIG. 11 is a plan view illustrating a state of the sheet feeding device in which oblique movement of a sheet is corrected after starting the feeding of the sheet.

Next, a description will be provided of processing to prevent oblique movement of the sheet by the sheet feeding device 6 with reference to FIGS. 10 and 11.

By setting the sheet 5 on the reference surface 7*b* and closing the upper cover 13, the spring 14 can press the sheet 5 against the sheet feeding roller 9. Thereafter, by driving the feeding motor 12, the sheet 5 can be fed. If, as shown in FIG. 10, the sheet 5 is obliquely positioned, when feeding of the sheet 5 begins by driving the feeding motor 12, the sheet 5 is conveyed by the sheet feeding roller 9 in a direction B because the sheet 5 is obliquely disposed. If the sheet 5 is conveyed in this state, a corner of the sheet 5 contacts the side plate 7*f*, and the sheet 5 rotates around a contact position D in a direction C. If the sheet 5 is further conveyed, the sheet 5 is fed while one side thereof moves along the side plate 7*f* in a direction A, as shown in FIG. 11. Accordingly, irrespective of the state in which the sheet 5 is set within the lower case 7, the sheet 5 is fed along the reference side plate 7*f* without obliquely moving.

Separation mechanism

Figure 12:
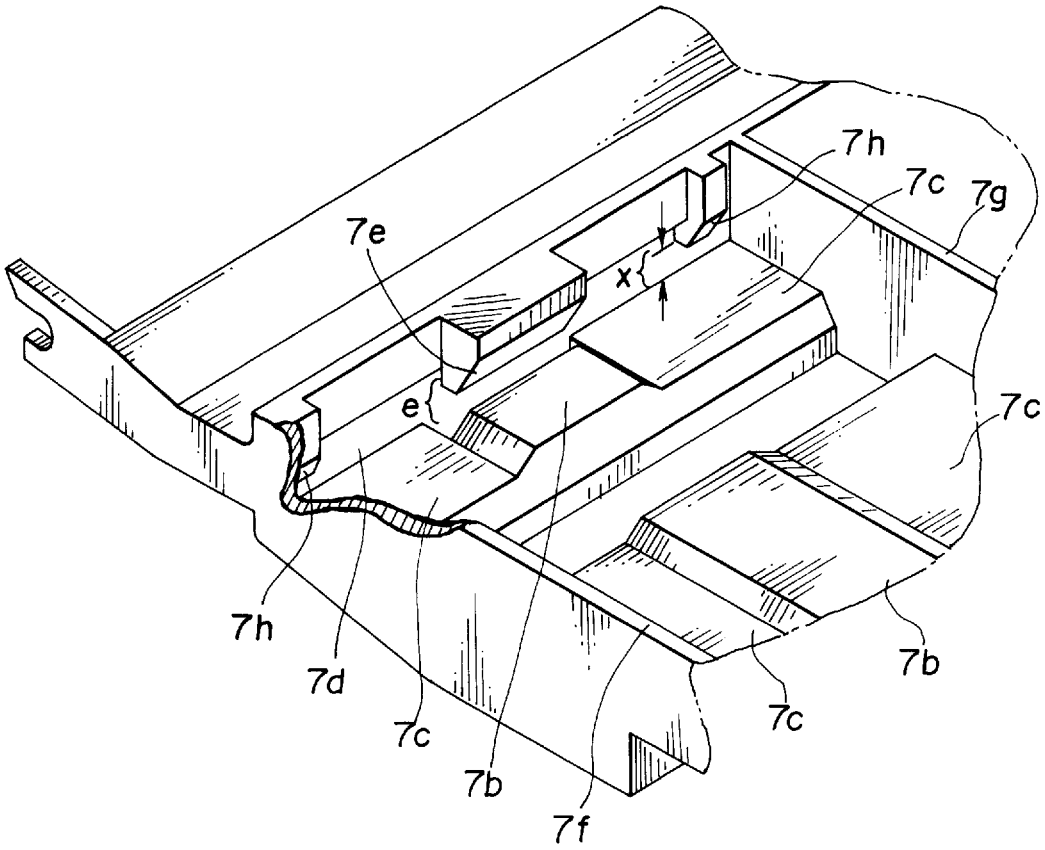
FIG. 12 is a perspective view illustrating a separation mechanism of the sheet feeding device.
Figure 13:
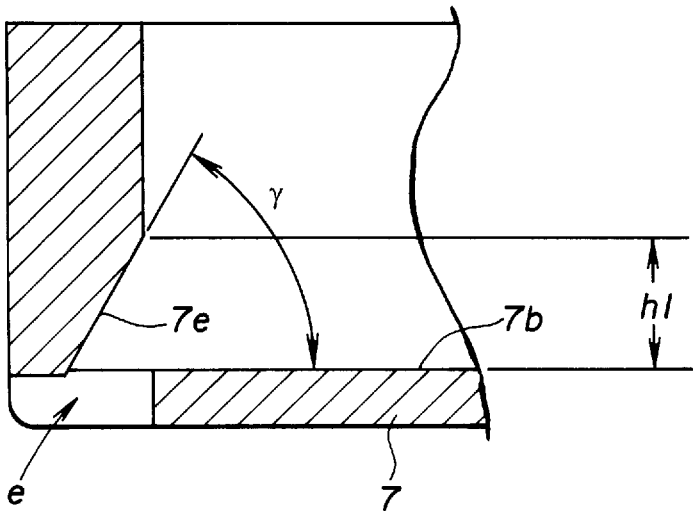
FIGS. 13(*a*) and 13(*b*) are vertical cross-sectional views illustrating the separation mechanism of the sheet feeding device.
Figure 13:
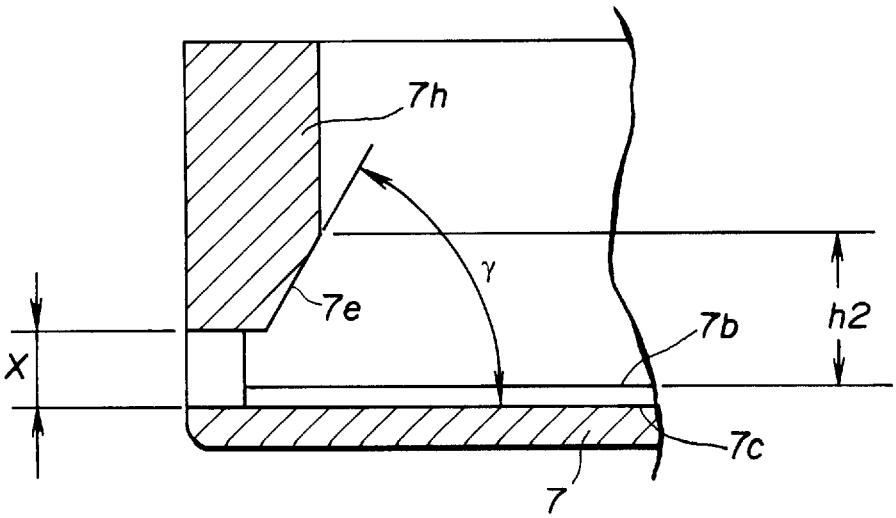
Figure 14A:
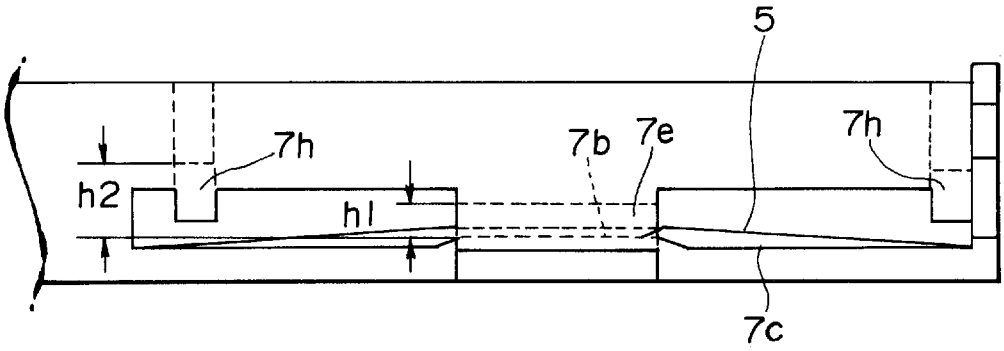
FIGS. 14(*a*) and 14(*b*) are plan views illustrating the separation mechanism of the sheet feeding device.
Figure 14B:
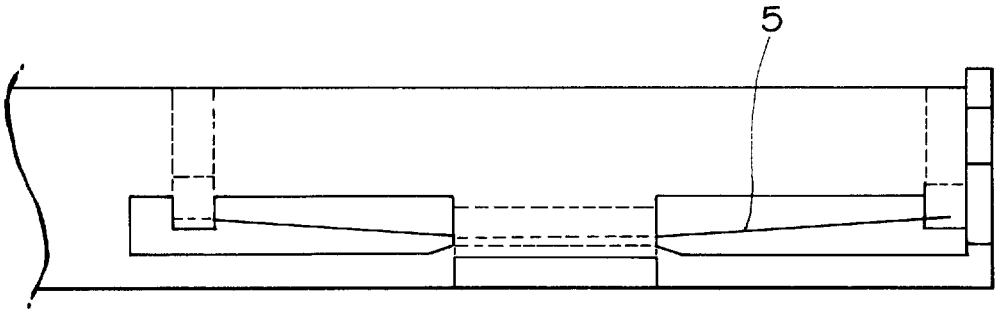

Next, a description will be provided of a separation mechanism of the sheet 5 with reference to FIGS. 12, 13 and 14.

FIG. 12 is a perspective view illustrating a separation portion.

In FIG. 12, as described above, the inclined portion (separation means) 7*e* for sheet separation is formed in the aperture 7*d*. Regulation members 7*h* are formed as one body on the side plates 7*f* and 7*g* on either side of the aperture 7*d*.

The regulation members 7*h* function as regulation means for regulating the passage of the sheet 5 by controlling the degree of curvature of the sheet 5 along its leading edge. Each of the regulation members 7*h* has an inclined surface to guide the sides of the leading edge of the sheet 5 to the aperture 7*d*.

When feeding a sheet 5 in a downwardly-convex curled state, as shown in FIG. 14(*b*), due to storage conditions or environmental conditions, the sheet 5 is in some cases fed while a side portion of the sheet 5 at the side of the side plate 7*f* moves in a direction opposite to the sheet-accommodating surface, because the feeding direction of the sheet feeding roller 9*a* is the direction B shown in FIG. 10. In such a case, if the amount of floating of the sheet 5 at the side of the side plate 7*f* is great, deviations in the sheet-feeding position and the recording position may occur. The regulation members 7*h* are provided in order to regulate such movement of the sheet 5 in the direction of the thickness.

Next, a description will be provided of a manner in which the sheet 5 is separated at the inclined portion 7*e*, serving as the separation means.

When the sheet feeding roller 9 rotates, the lowermost sheet 5 of the sheets mounted on the lower case 7 is fed, and the leading edge of the fed sheet 5 contacts the inclined portion 7*e*. The inclined portion 7*e* generates a drag to downwardly press the sheet 5 against the feeding force of the sheet feeding roller 9*a*. As a result, the sheet 5 is bent, and the lowermost sheet 5 is separated from the inclined portion 7*e*.

Although in the present embodiment, the regulation members 7*h* are provided so as to regulate two end portions of the sheet 5, the regulation member 7*h* may be provided only on the side plate 7*f* so as to regulate at least a side of the sheet 5 at the side of the side plate 7*f*, serving as the recording reference position.

Although in the present embodiment, an inclined surface is formed on the regulation member 7*h*, a curved surface or a surface having a circular cross section may also be formed.

FIG. 13(*a*) is a cross-sectional view of the inclined portion 7*e* for sheet separation. The reference surface 7*b* and a gap e for passing the sheet 5 is formed in the vicinity of the inclined portion 7*e*. The slope of the inclined portion 7*e* has an angle γ with respect to the reference surface 7*b*. In the present embodiment, the angle γ is set to 60°. The angle γ may have any other value within the range of 30°–80°.

In the present embodiment, the height h1 of the slope formed on the inclined portion 7*e* is set to be at least the maximum expected height of curl of the sheet 5 contacting the inclined portion 7*e*. In the present embodiment, the value of the height h1 is set to 9 mm.

FIG. 13(*b*) is a cross-sectional view of the regulation member 7*h*. The regulation member 7*h* is separated by a gap having an interval X from the supporting surface 7*c*. The angle made by the slope of the regulation member 7*h* and the supporting surface 7*c* is the angle γ of the inclined portion 7*e* for sheet separation. The interval X provides the amount of floating of the sheet 5 from the supporting surface 7*c* allowed for ordinary feeding and recording. In the present embodiment, X=2 mm.

As in the case of the height h1, the height h2 of the slope formed on the regulation member 7*h* is set to be at least the estimated height of curl of the sheet 5 contacting the regulation member 7*h*, more specifically, at least the height of floating of the sheet 5 from the reference surface 7*b*. In the present embodiment, since the height of floating has a maximum value when feeding a single sheet, the height in this case is set as the height of floating of the sheet 5. The height h2 of the slope of the regulation member 7*h* is set to a value higher than the height h1 assuming that the height of curl of the sheet 5 produced in the regulation member 7*h* is higher than the height h1. In the present embodiment, the height h2 is set to 12 mm.

In the present embodiment, the angle γ between the slopes of the inclined portion 7*e* and the regulation member 7*h*, and the reference surface 7*b* and the supporting surface 7*c*, respectively, equals 60°. If the angle γ is less than 30°, there is the possibility that the leading edges of the second sheet and/or subsequent sheets enter the gap e together with the first sheet while the first sheet is fed. Hence, it is desirable that the angle γ is at least 30°. The inclined portion 7*e* and the regulation member 7*h* make the same angle γ with the reference surface 7*b* and the supporting surface 7*c*, respectively. However, since the gap X between the regulation member 7*h* and the supporting surface 7*c* is much greater than the thickness of the sheet 5, there is less possibility that the leading edges of the second and/or subsequent sheets will enter the gap X. Hence, the angle made by the regulation member 7*h* and the supporting surface 7*c* may be different from the angle made by the sloped portion 7*e* and the reference surface 7*b*, or may be less than 30°. Although in the present embodiment, the heights h1 and h2 of the slopes provided in the inclined portion 7*e* and the regulation member 7*h*, respectively, are arranged to be h2>h1, the relationship between the heights h1 and h2 is not limited to this relationship, but may be set in accordance with an estimated curled state of the sheet 5. For example, the relationship may be set to h1=h2.

FIG. 10 illustrates a manner in which the sheet 5 is fed from the sheet feeding device 6.

FIGS. 14(*a*) and 14(*b*) illustrate a state before starting the feeding operation, as seen from the front side. The sheet 5 is not always flat depending on environmental conditions, such as the ambient temperature and humidity, and conditions of use. For example, upwardly convex curl and downwardly convex curve may occur, as shown in FIGS. 14(*a*) and 14(*b*), respectively.

The heights h1 and h2 of the slope provided in the inclined portion 7*e* for sheet separation and the regulation member 7*h*, respectively, are set to values greater than the height of curl of the sheet 5 contacting the respective members. Hence, even if the sheet 5 is curled, end portions of the sheet 5 contact the slopes of the inclined portion 7*e* and the regulation member 7*h*, and the sheet 5 is guided to the gap e formed for passing the sheet 5. The height h2 is set to be equal to or greater than the height hi so that the sheet 5 is normally fed even in the above-described curled states.

The supporting surface 7*c* is made to be lower than the reference surface 7*b* and the upper surface of the roller units 9*a* of the sheet feeding roller 9 in order to reduce the force required for the spring 14, because a large force is needed for pressing the sheet 5, in which upwardly convex curl has been produced as shown in FIG. 14(*a*), against the sheet feeding roller 9 to a flat state by the spring 14 (see FIG. 6).

At that time, since the sheet feeding roller 9 has the two roller units 9*a* at the predetermined interval, the sheet 5 can contact the sheet feeding roller 9 with excellent balance even in a curled state, so that the sheet 5 can be precisely fed. For example, when the sheet 5 is in an upwardly-convex curled state, the roller units 9*a* can contact the sheet 5 at portions where the height of curl is the same, because, as shown in FIG. 9, the roller units 9*a* of the sheet feeding roller 9 are disposed across the center of the sheet 5 in the lateral direction. Also in the case of downwardly convex curl, the sheet feeding roller 9 can feed the sheet 5 while contacting it with excellent balance, because the roller units 9*a* contact the sheet 5 across the apex of the curl.

Figure 15A:
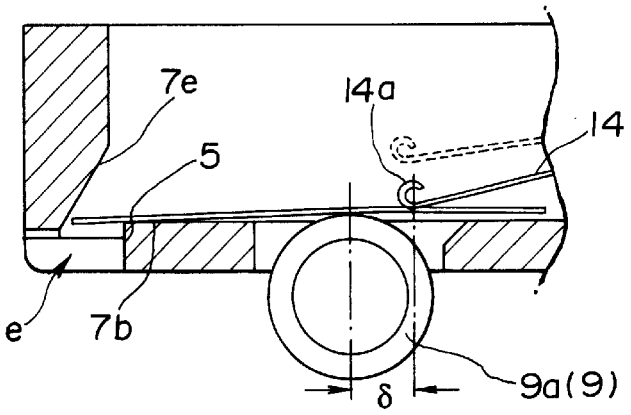
FIGS. 15(*a*) through 15(*c*) are cross-sectional views illustrating a sheet feeding state by a sheet feeding roller of the sheet feeding device.
Figure 15B:
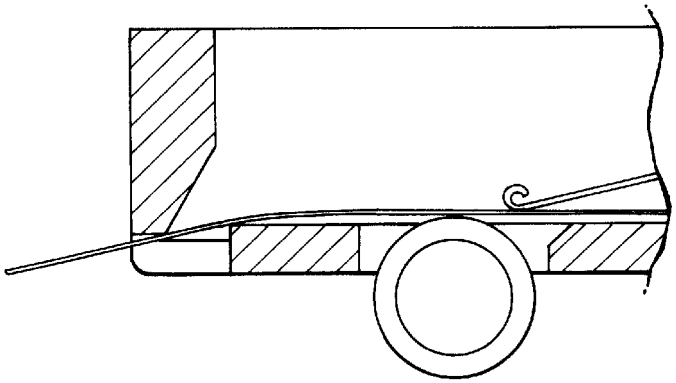
Figure 15C:
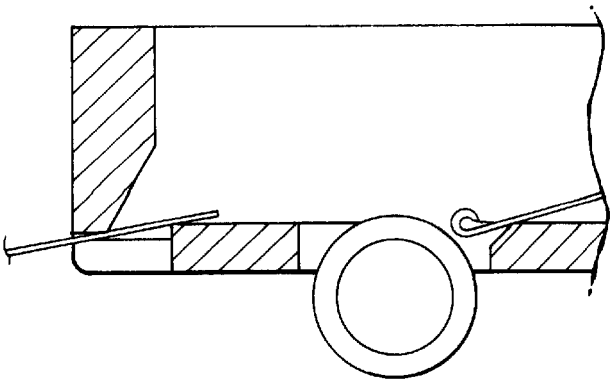

FIG. 15(*a*) is a cross-sectional view illustrating the positional relationship between the spring 14, for contacting the sheet 5 to the sheet feeding roller 9 while pressing the sheet 5, and the sheet feeding roller 9. A portion where the spring 14 presses against the roller units 9*a* of the sheet feeding roller 9 is always positioned at an upstream side (the right side in FIG. 15(*a*)) from the center of rotation of the sheet feeding roller 9 irrespective of the number of mounted sheets to be separated and fed. When only a single sheet is present, the portion is situated at a position more upstream by δ. Thus, the sheet 5 is always pressed against the sheet feeding roller 9 by the spring 14. Hence, when a leading-edge portion of the lowermost sheet 5 passes through the inclined portion 7*e*, entrance of sheets mounted on the lowermost sheet into the gap e is prevented, the sheet 5 can be easily bent at the inclined portion 7*e* for sheet separation, and therefore feeding of a plurality of sheets is prevented (see FIG. 15(*b*)). A leading-end portion 14*a* of the spring 14 is configured so as not to contact the roller units 9*a* of the sheet feeding roller 9 even if the sheet is absent (see FIG. 15(*c*)).

Figure 16A:
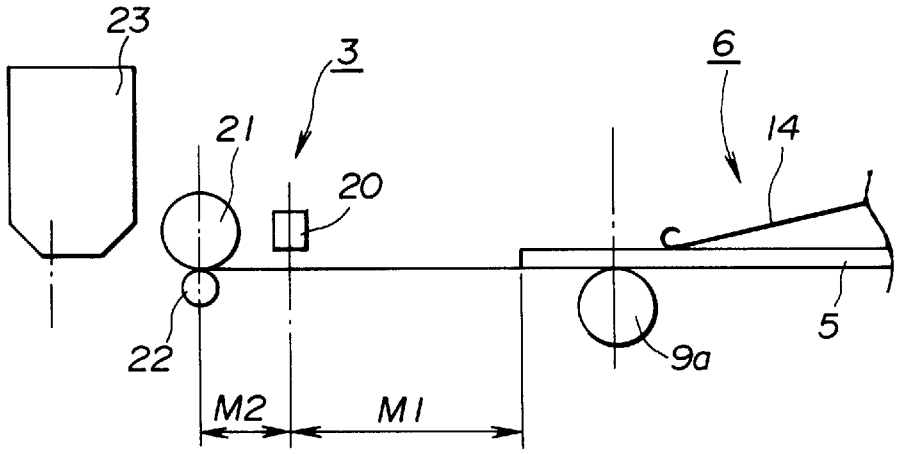
FIGS. 16(*a*) and 16(*b*) are diagrams illustrating feeding control of a sheet from the sheet feeding device to a recording unit.
Figure 16B:
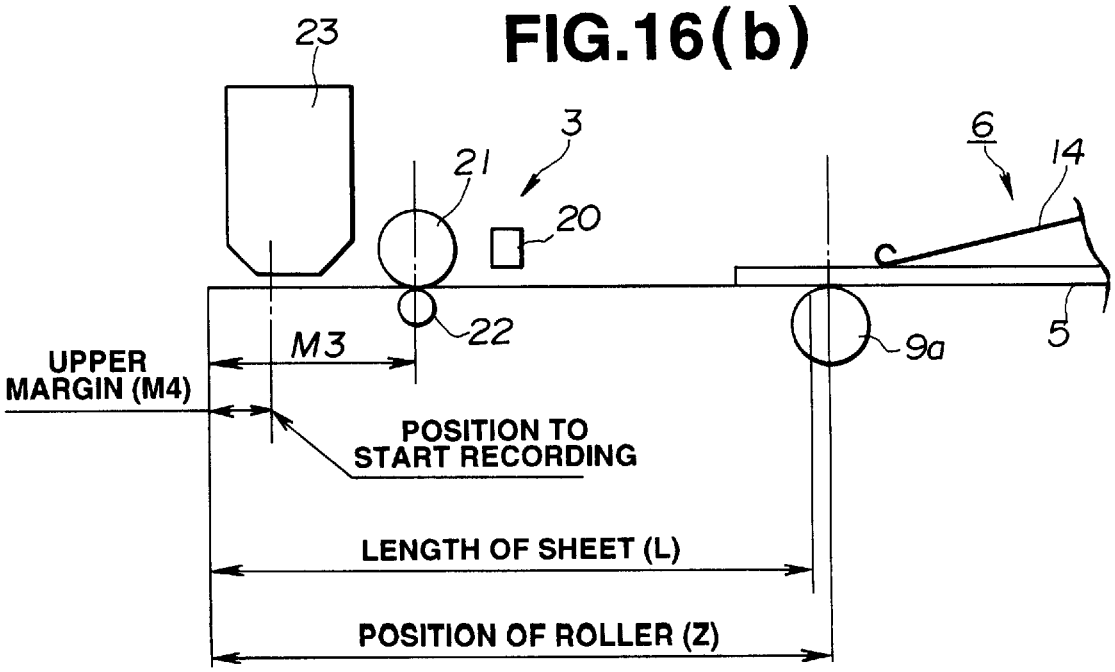

The positional relationship between the sheet feeding device and the recording unit FIGS. 16(*a*) and 16(*b*) are schematic diagrams illustrating the arrangement of the sheet feeding device 6 and the recording unit 3. In FIG. 16(*a*), reference numeral 20 represents a sheet detection sensor for detecting the presence of a sheet within the recording unit 3. Reference numeral 21 represents a conveying roller, and reference numeral 22 represents a pinch roller driven by the conveying roller 21 by a spring or the like (not shown). The conveying roller 21 and the pinch roller 22 constitute conveying means. Reference numeral 23 represents a recording head (recording means) for forming an image on the sheet.

In FIG. 16(*a*), when the set sheet 5 has been fed by the sheet feeding roller 9 toward the conveying roller 21 of the recording unit 3 by a distance M1, the leading edge of the sheet 5 is detected by the sheet detection sensor 20. When the sheet 5 has been further fed by a distance M2, the leading edge of the sheet 5 reaches a so-called nip portion where the conveying roller 21 contacts the pinch roller 22. Thereafter, the sheet 5 is conveyed by the conveying roller 21, as illustrated in FIG. 16(*b*). The leading edge of the sheet 5 passing through the nip portion between the conveying roller 21 and the pinch roller 22 is further conveyed by a distance M3. The distance M3 is adopted in consideration of a blank portion from the leading edge of the sheet 5 to a position where printing is actually performed, i.e., a so-called upper margin M4. The sheet feeding roller 9 is disposed at a position where the trailing edge of the sheet 5 passes while the leading edge of the sheet 5 is conveyed by the distance M3. That is, as shown in FIG. 16(*b*), the length L of the sheet is less than the position Z of the roller. Since the value of the upper margin M4 differs depending on images to be recorded, the value of the position Z of the roller may be determined from the minimum value of the upper margin M4.

Positional relationship between the sheet feeding roller and the sheet

Figure 17A:
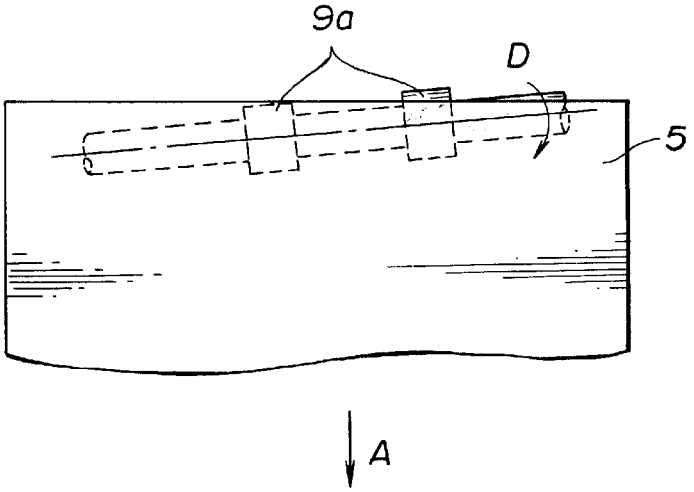
FIGS. 17(*a*) through 17(*c*) are diagrams illustrating a state in which oblique movement of a sheet fed from the sheet feeding device is corrected.
Figure 17B:
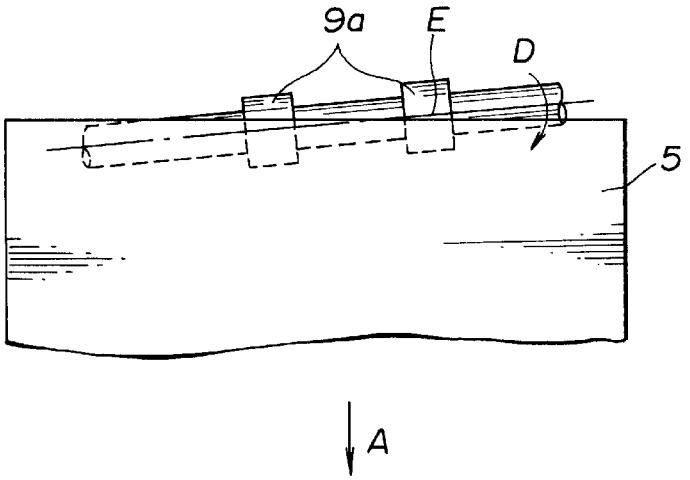
Figure 17C:
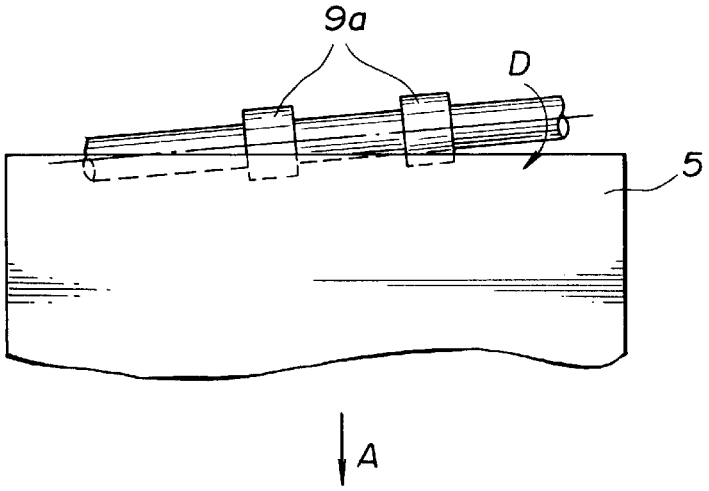

Next, a description will be provided of the positional relationship between the sheet feeding roller 9 and the trailing edge of the sheet 5 with reference to FIGS. 17(*a*) through 17(*c*).

In FIGS. 17(*a*) through 17(*c*), the sheet 5 is fed in a direction A by the rotation of the sheet feeding roller 9 in a direction D.

As described above, the sheet feeding roller 9 has two roller units 9*a*, and is obliquely disposed with respect to a direction orthogonal to the sheet-feeding direction (the direction A). Accordingly, in a state shown in FIG. 17(*a*), the two roller units 9*a* contact the sheet 5. When the sheet 5 is further fed and assumes a state shown in FIG. 17(*b*), the trailing edge of the sheet 5 is detached from one of the roller units 9*a*. When the sheet 5 is further fed and assumes a state shown in FIG. 17(*c*), the trailing edge of the sheet 5 is also detached from the other roller unit 9*a*. FIG. 17(*c*) illustrates the position where the trailing edge of the sheet 5 passes through the sheet feeding roller 9 when the sheet 5 is conveyed by the distance M3, as shown in FIG. 16(*b*).

In FIGS. 17(*a*) through 17(*c*), the next sheet to be fed contacts the upper surface of the sheet 5 being fed, and the spring 14 for pressing the sheets against the sheet feeding roller 9 presses the sheets from above. Accordingly, in the state shown in FIG. 17(*b*), the next sheet contacts the roller unit 9*a*, that has been detached from the trailing edge of the sheet 5 being fed, at a point E. Feeding of the next sheet in the direction A is prevented by the resistance of the separation portion (inclined portion 7*e*), and this resistance prevents the rotation of the sheet feeding roller 9 thereon.

Usually, when the sheet feeding roller 9 is disposed in a direction orthogonal to the sheet-feeding direction, and a slippable mechanism, such as a one-way clutch or the like, is provided for the sheet feeding roller 9, i.e., when the sheet-feeding direction coincides with the direction in which the sheet is actually fed, the drive of the sheet feeding roller 9 is stopped in the state shown in FIG. 17(*a*), and the sheet 5 is drawn by the conveying roller 21 of the recording unit 3. In such an approach, however, if the sheet feeding roller 9 is obliquely disposed with respect to the direction orthogonal to the sheet-feeding direction, frictional load at the point E prevents the rotation of the sheet feeding roller 9. Hence, a large conveying force capable of conveying the sheet 5 against the frictional load is needed for the recording unit 3.

The conveying force of the recording unit 3, i.e., the driving force of the conveying roller 21, can be reduced by driving the sheet feeding roller 9 until the the state shown in FIG. 17(*c*) is provided, i.e., the trailing edge of the sheet 5 completely passes through the sheet feeding roller 9

Feeding force

Even when the sheet 5 has been fed by the sheet feeding roller 9 and reached the conveying roller 21 of the recording unit 3, the sheet feeding roller 9 must be rotated for an additional period to ensure the leading edge of the sheet 5 is present at the nip portion between the conveying roller 21 and the pinch roller 22.

If the feeding force of the sheet feeding roller 9 is greater than the stiffness of the sheet 5, the sheet 5 is bent. The stiffness of the sheet 5 changes depending on the ambient temperature and humidity. In particular, a large feeding force is needed for assuredly bending a thick sheet, such as a post card or the like.

In the present embodiment, the feeding force is set to a value smaller than the minimum stiffness of the sheet, so that slip is always produced between the sheet 5 and the sheet feeding roller 9 without bending the sheet 5. The feeding force can be appropriately set by adjusting the pressing force (sheet-feeding pressure) to press the sheet 5 against the sheet feeding roller 9, i.e., the spring force of the spring 14 for pressing the sheet 5 against the sheet feeding roller 9. The spring force may be set so as to satisfy the following relational expressions (1)–(3):

$$FB<FK \quad (1)$$

$$FN_{min}<FK<FN_{max} \quad (2)$$

$$FK<FZ \quad (3),$$

where $FN_{max}$ and $FN_{min}$ are the maximum value and the minimum value of the pushing force to push the sheet 5 into the nip portion between the conveying roller 21 and the pinch roller 22, respectively, FB is a force necessary to separate the sheets by the separation means, FZ is the buckling force of the sheet, and FK is the feeding force of the sheet by the sheet feeding roller 9. If the pushing force exceeds the value $FN_{max}$, the leading edge of the sheet does not stop at and enters the nip portion, so that positioning of the leading edge of the sheet cannot be exactly performed. If the pushing force is less than the value $FN_{min}$, the leading edge of the sheet cannot be grasped by the nip portion when the conveying roller 21 starts to feed the sheet while rotating, thereby causing a failure in feeding.

The spring force of the spring 14 for pressing the sheet 5 against the sheet feeding roller 9 is set so as to satisfy the relational expressions (1)–(3). The same effects may be obtained by appropriately selecting the coefficient of friction of the roller units 9*a* of the sheet feeding roller 9.

Control means

Figure 18:
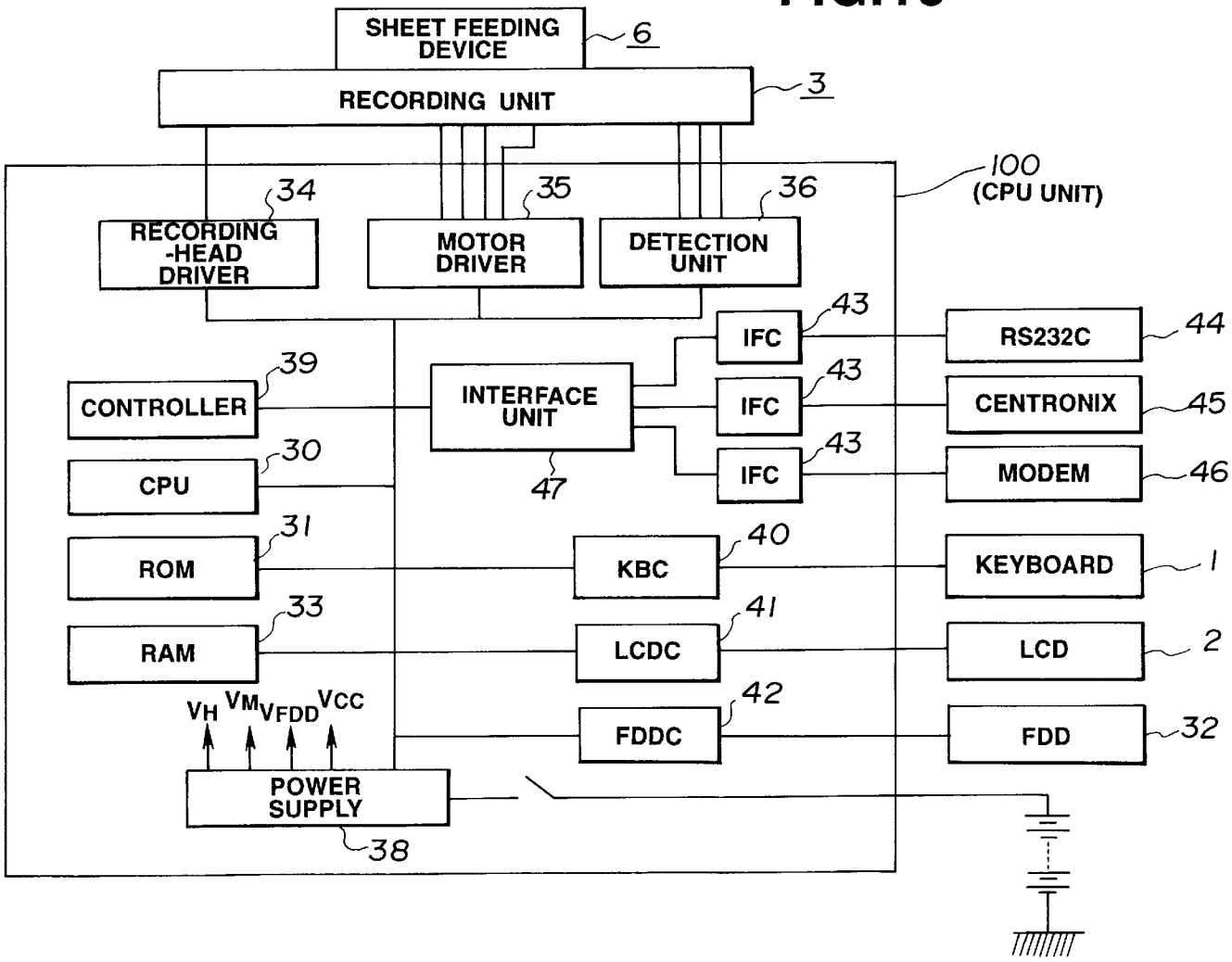
FIG. 18 is a block diagram of control means provided in the word processor.

Next, a description will be provided of control means for performing driving control of the sheet feeding device 6, and the recording unit 3 using the sheet feeding device 6, with reference to a block diagram shown in FIG. 18.

In the block diagram shown in FIG. 18, only the connections between respective units are shown, and detailed control lines are omitted.

In FIG. 18, a CPU 30 includes control means for reading programs and various kinds of data from a ROM (read-only memory) 31 (to be described later), or from a floppy-disk drive 32 and the like. The CPU performs necessary calculations and determinations, and performs various kinds of controls.

The ROM 31 stores various kinds of programs to be used by the CPU 30, and various kinds of data necessary for recording, such as character codes, dot patterns (to perform the function of a character generator (CG)) and the like.

A RAM (random access memory) 33 functions as a read/write memory, and includes, inter alia, (i) a working area for temporarily storing data being accessed and results of calculations, (ii) a buffer area for storing various kinds of data input from the keyboard 1, the external interface unit 47, and the floppy-disk drive 32, etc., and (iii) a text area for preserving documents. A CPU unit 100 is connected to the recording unit 3 via a recording-head driver 34, a motor driver 35 and a detection unit 36.

The recording-head driver 34 drives the recording head 23 provided in the recording unit 3 under the control of the CPU 30. The motor driver 35 drives a conveying motor (not shown), serving as a driving source for, inter alia, the conveying roller 21, a carriage motor (not shown) for moving the recording head 23 in a direction orthogonal to the conveying direction of the sheet 5, and the feeding motor 12.

The detection unit 36 transmits detection information from the sheet detection sensor 20 provided in the recording unit 3, a temperature/humidity detection sensor for detecting the temperature and humidity within the device, and the like, to the CPU 30. A power supply 38 controls the supply of a power supply $V_H$ for driving the recording head 23, a power supply $V_M$ for driving the conveying motor, the carriage motor, the feeding motor 12 and the like, a power supply FDD for driving the floppy-disk driver 32, and a power supply $V_{CC}$ for other logic circuits.

A controller 39 transfers data to be recorded by the recording head 23, changes the voltage and current of the driving power supply $V_H$, and performs various kinds of controls by the control of the CPU 30. The keyboard 1 for inputting various kinds of data necessary for recording and editing is connected to the CPU unit 100 via a keyboard connector (KBC) 40.

The display unit 2, including an LCD (liquid-crystal display), for displaying data and various kinds of information input from the keyboard 1 is connected to the CPU unit 100 via an LCD connector (LCDC) 41. A CRT or any other device may be used instead of the LCD for the display unit 2. The floppy-disk drive 32 is also connected to the CPU 100 via a floppy-disk-drive connector (FDDC) 42. A hard-disk drive, an external RAM or the like may be connected instead of the floppy-disk drive. Interfaces, such as an RS232C 44, a Centronix 45, a modem 46 and the like, for performing control of the recording unit 3 and communication with an external apparatus by an external control device, can be connected to the CPU unit 100 via interface connectors (IFC) 43.

Control operation

Figure 19:
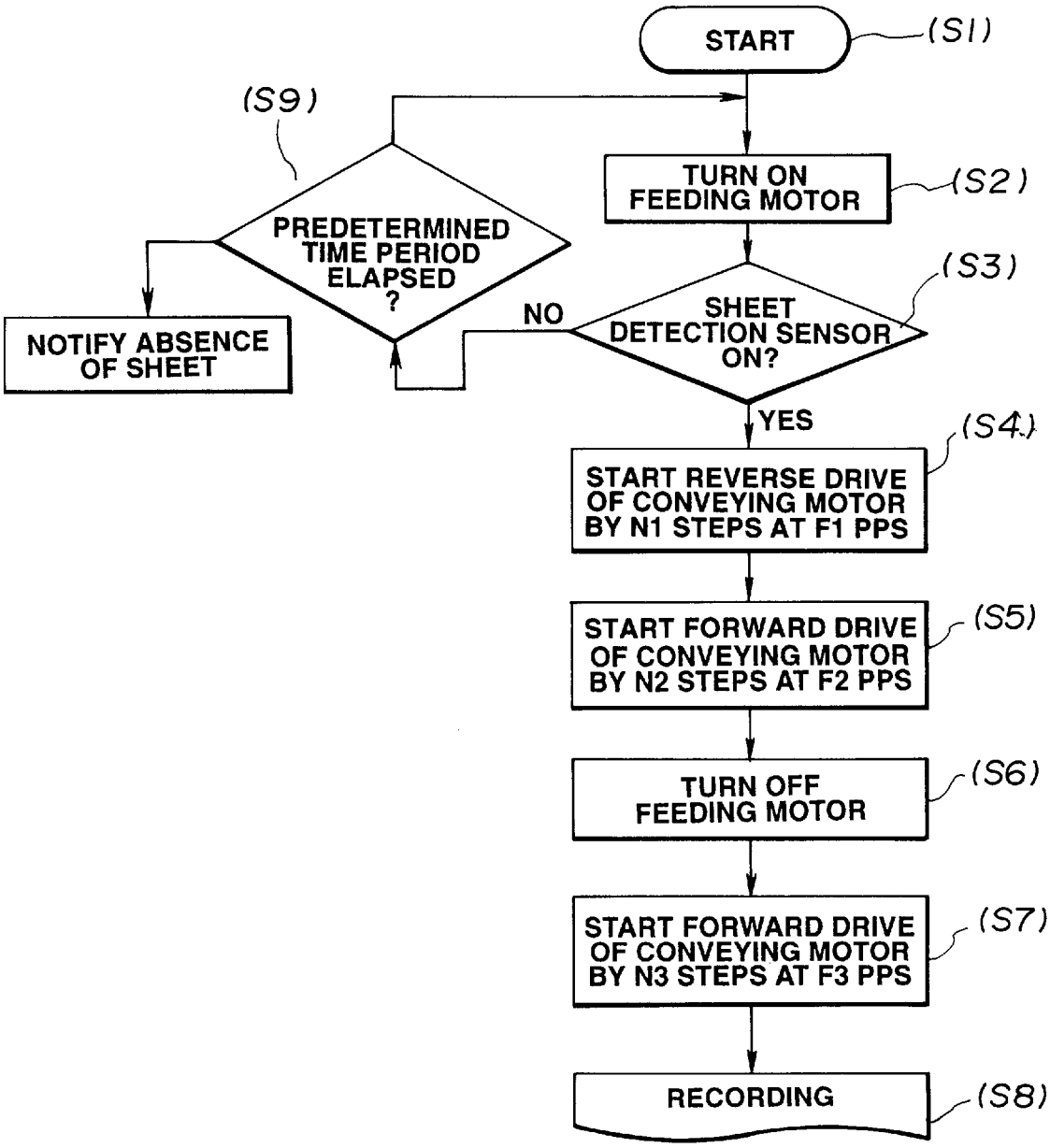
FIG. 19 is a flowchart illustrating an example of sheet-feeding control.

Next, a description will be provided of control procedures for performing driving control of the sheet feeding device 6, and the recording unit 3 using the sheet feeding device 6, with reference to a flowchart shown in FIG. 19.

When a recording command has been received and a sheet-feeding operation has been started (step S1), the feeding motor 12, such as a DC motor, is turned on (step S2), and feeding of the lowermost sheet 5 contacting the roller units 9*a* of the sheet feeding roller 9 is started.

When the sheet 5 has been fed by the distance M1 shown in FIG. 16(*a*), the sheet detection sensor 20 is turned on (step S3), the drive (reverse drive) of the conveying motor of the recording unit 3 in a direction reverse to the sheet-feeding direction by a predetermined amount N1 steps at a predetermined speed F1 pps is started (step S4). In the present embodiment, a stepping motor is adopted as the conveying motor.

When the sheet 5 has been further fed from the position corresponding to the sheet detection sensor 20 by the distance M2 by the sheet feeding device 6, the sheet 5 contacts the conveying roller 21 driven in a direction opposite to the sheet-feeding direction by the conveying motor. By further driving the feeding motor 12 for a predetermined time period, the leading edge of the sheet 5 can assuredly contact the conveying roller 21 along the nip portion between the conveying roller 21 and the pinch roller 22 while producing slip between the sheet 5 and the sheet feeding roller 9. Thus, oblique movement of the sheet 5 is corrected. Although oblique movement of the sheet 5 is corrected when the sheet 5 is fed from the sheet feeding device 6, the sheet 5 may be obliquely fed to the recording unit 3 depending on accuracy when mounting the sheet feeding device 6 on the word processor WP. The above-described operation is performed in order to assuredly correct such oblique movement.

Thereafter, the conveying motor is (forwardly) driven in the sheet-feeding direction by a predetermined amount N2 steps at a predetermined speed F2 pps by switching the drive of the conveying motor (step S5). At that time, the sheet 5 is conveyed by the conveying roller 21 of the recording unit 3 while being fed by the sheet feeding roller 9 driven by the feeding motor 12 of the sheet feeding device 6. When switching the direction of revolution or changing the speed of revolution of the conveying motor, the revolution of the conveying motor is stopped for 0.1 second.

The feeding motor 12 is turned off after driving the conveying motor by N2 steps (step S6). The fed distance of the sheet 5 by the drive of the feeding motor 12 and the conveying motor is the distance necessary to detach the trailing edge of the sheet 5 is detached from the roller units 9*a* of the sheet feeding roller 9. The feeding motor 12 is not turned off when the conveying motor has started the drive in the sheet-feeding direction. If the feeding motor 12 is turned off immediately when the leading edge of the sheet 5 has reached the conveying roller 21, a failure in sheet conveyance may occur because the leading edge of the sheet 5 may not have entered the nip portion between the conveying roller 21 and the pinch roller 22. In addition, as described above, if it is intended to convey the sheet 5 only by the conveying roller 21 in a state in which the trailing edge of the sheet 5 reaches the sheet feeding roller 9, a large conveying force is needed for the conveying roller 21.

After turning off the feeding motor 12, the conveying motor is further (forwardly) driven in the sheet-feeding direction by a predetermined amount N3 steps at a predetermined speed F3 pps (step S7), and the sheet 5 is conveyed to a position to start recording. The distance M3 shown in FIG. 16(*b*) corresponds to the drive of (N2+N3) steps of the conveying motor.

When the sheet 5 has been conveyed to the position to start recording, a recording operation is started (step S8).

The predetermined speed F1 pps when driving the conveying motor in a direction opposite to the sheet-feeding direction is set to a value equal to or less than the speed F3 pps in step S7 in order to prevent fluttering of the leading edge of the sheet 5. The speed F2 pps of the conveying motor driven together with the feeding motor 12 is set to a value equal to or less than the revolution speed of the feeding motor 12, and equal to or less than the above-described speed F1 pps.

$$F2\ \text{pps} \leqq F1\ \text{pps} \leqq F3\ \text{pps}$$

The revolution speed corresponding to F2 pps≦the speed of revolutions of the feeding motor.

If the revolution speed of the feeding motor 12 is set to a value less than the revolution speed of the conveying motor, load at the sheet feeding roller 9 (a resistive force against sheet conveyance) increases, so that a desired amount of feeding may not be achieved. If the desired amount of feeding is not achieved, there is the possibility that the sheet 5 does not reach an ordinary position to start recording, and therefore, in the worst case, recording is performed while the sheet is absent. In order to prevent the occurrence of such a case, the conveying force at the recording unit 3 (the driving force of the conveying roller 21) must be increased, thereby causing an increase in the cost and the size of the sheet feeding device 6.

In step S3, if the sheet detection sensor 20 is not turned on after the feeding motor 12 has been turned on, the drive of the feeding motor 12 is continued within a predetermined time period. After the lapse of the predetermined time period, it is determined that the sheet to be fed is absent, and the absence of the sheet is reported after stopping the sheet-feeding operation. In the present embodiment, the predetermined time period is set to 5 seconds. As shown in FIG. 15(*c*), the spring 14 is disposed at a position where the roller units 9*a* of the sheet feeding roller 9 are absent, i.e., where the spring 14 does not contact the roller units 9*a*, in order that the spring 14 and the sheet feeding roller 9 are not damaged even if there are no sheets to be fed in the sheet feeding device 6.

Recording means

As described above, the recording means (the recording head 23) records an ink image on a recording sheet conveyed by the conveying means. An ink-jet recording method is favorably used for the recording means in the present apparatus.

Ink-jet recording means includes liquid-discharging ports for discharging an ink liquid for recording as flying droplets, a liquid channel communicating with the liquid-discharging ports, and discharging-energy generation means, provided at a portion of the liquid channel, for providing discharging energy for forcing the ink liquid through the liquid channel. The discharging-energy generation means is driven to discharge ink liquid droplets in accordance with an image signal to record an image.

Pressure-energy generation means, for example, an electromechanical transducer, such as a piezoelectric element or the like; electromagnetic-energy generation means for heating an ink liquid by projecting an electromagnetic wave, such as a laser or the like, and discharging ink droplets generated by the heating; thermal-energy generation means for discharging ink droplets by heating an ink liquid using an electrothermal transducer, or the like is used as the discharging-energy generation means.

Among these approaches, a method in which ink droplets are discharged using the thermal-energy generation means using an electrothermal transducer is preferable, because liquid-discharging ports can be arranged at high density, so that high-resolution recording can be performed and a small-size recording head can be provided. In this method, film boiling produced in the ink by thermal energy provided by the electrothermal transducer is utilized, and the ink is discharged from the discharging ports.

Figure 20:
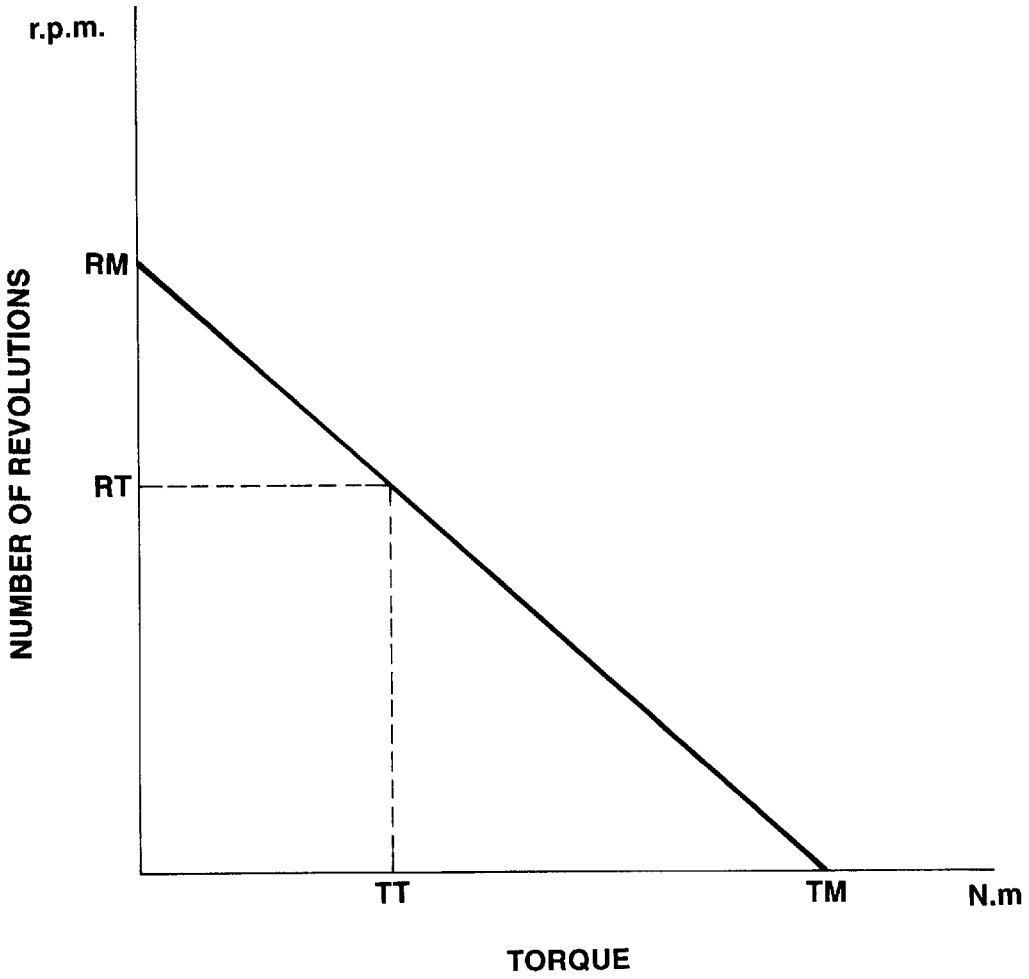
FIG. 20 is a graph illustrating the relationship between the number of revolutions and the torque of a motor provided in the sheet feeding device.

Next, a description will be provided of another embodiment of the sheet feeding device 6 with reference to FIG. 20.

In the above-described embodiment, by driving the sheet feeding roller 9 for a predetermined time period after the sheet 5 fed by the sheet feeding roller 9 has reached the conveying roller 21 of the main body, slip is produced between the sheet 5 and the sheet feeding roller 9. However, the present invention is not limited to such an approach. For example, in the present embodiment, a DC motor is adopted as the feeding motor 12. As shown in FIG. 20, a DC motor has characteristics in which the number of revolutions of the motor is inversely proportional to the load torque, and the revolution of the motor stops when the torque exceeds a predetermined value. The present embodiment utilizes such characteristics.

In FIG. 20, if the torque of the feeding motor 12 necessary for feeding the sheet in a usual manner equals TT, the number of revolutions of the feeding motor 12 at that time equals RT, and the sheet feeding roller 9 rotates at the number of rotations obtained from the number RT by taking into consideration of the reduction ratio of a drive transmission mechanism and the transmission efficiency. As the value of the torque TT increases, the number of revolutions decreases. When the value of the torque equals TM, the number of revolutions equals 0. The torque TM is called a starting torque. The motor can rotate when the value of the load is less than the starting torque. The value of the starting torque can be freely set by changing the diameter of the wire and the number of turns of the coil within the motor.

Accordingly, the starting torque is set so that the number of revolutions of the feeding motor 12 becomes 0 before the sheet 5 is bent when driving the sheet feeding roller 9 for a predetermined time period after the sheet 5 fed by the sheet feeding roller 9 has reached the conveying roller 21 of the main body.

That is, if the value of a force necessary to bend the sheet 5 converted into the value of the motor torque is represented by TS, the torque TM may be set so that the relationship of TS>TM holds. At that time, although the number of revolutions of the feeding motor 12 equals 0, since the sheet 5 is brought in contact with the conveying roller 21 by a feeding force generated from the torque TM, the leading edge of the sheet 5 can be assuredly aligned with the conveying roller 21. The above-described relational expressions (1) and (2) must also be satisfied.

The feeding motor 12, serving as a driving source for the sheet feeding roller 9 functioning in the above-described manner, acts as feeding-force providing means K as the spring 14 in the above-described embodiment.

Figure 21:
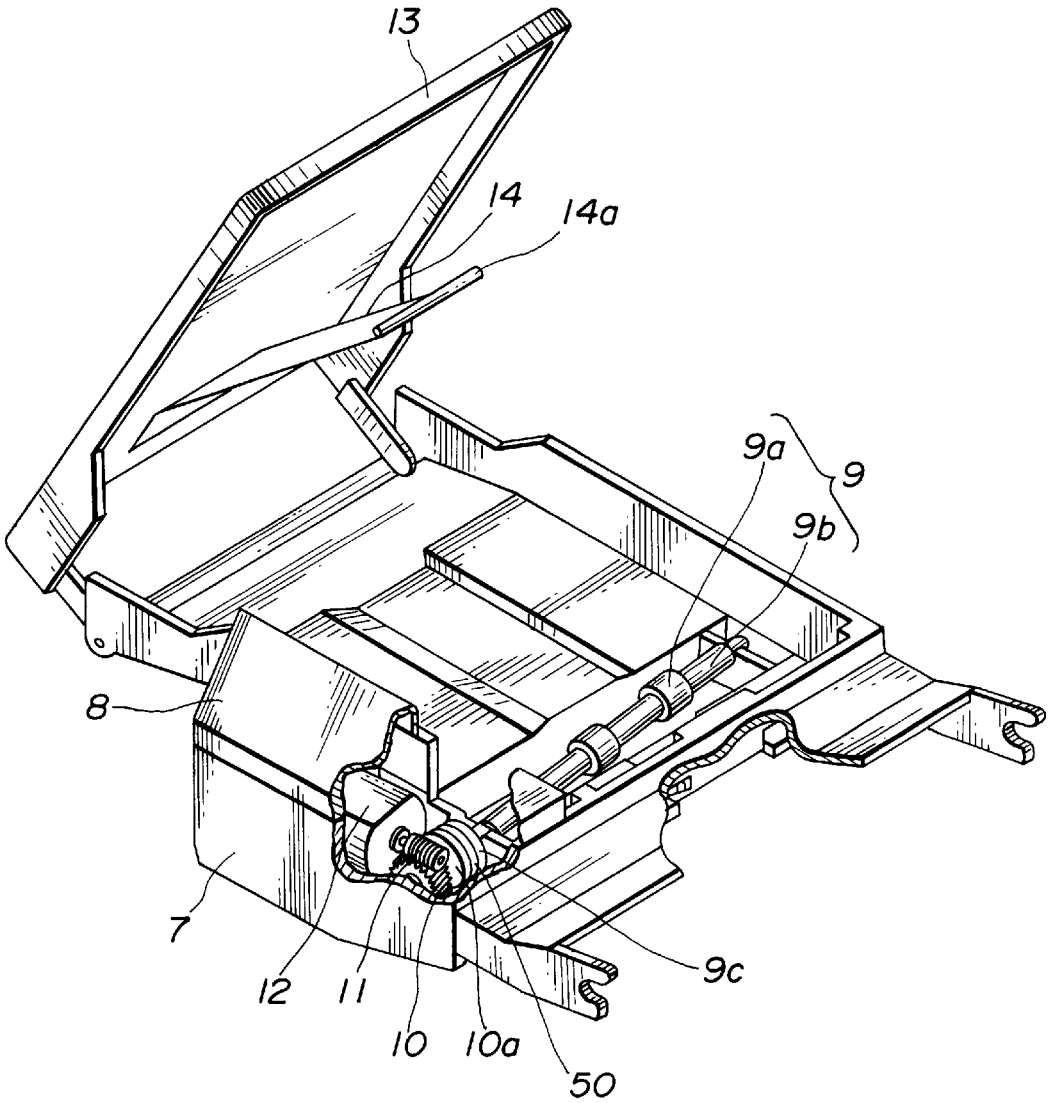
FIG. 21 is a perspective view illustrating another example of the sheet feeding device.

Next, a description will be provided of still another embodiment of the sheet feeding device 6 with reference to FIG. 21.

In the above-described embodiments, slip is produced between the sheet 5 and the sheet feeding roller 9 when driving the sheet feeding roller 9 for a predetermined time period after the sheet 5 fed by the sheet feeding roller 9 has reached the conveying roller 21 of the main body, or the starting torque of the DC motor, serving as the feeding motor 12, is set to such a small value that the sheet 5 is not bent. The same effects may also be obtained by providing, as shown in FIG. 21, a frictional member 50, such as a felt or the like, functioning as a torque limiter between a pedestal 9*c* provided at one end portion of the sheet feeding roller 9 and one end portion 10*a* of the worm gear, and by driving the frictional member 50 in the axial direction of the sheet feeding roller 9 by a spring (not shown).

The force of the spring for driving the frictional member 50 is set to a value greater than the driving force of the feeding motor 12 transmitted to the sheet feeding roller 9 for feeding the sheet 5, and smaller than a force necessary to bend the sheet 5 when driving the sheet feeding roller 9 for a predetermined time period after the sheet 5 has reached the conveying roller 21 of the main body. That is, the spring force to set the limit value of the torque limiter may satisfy the above-described relational expressions (1)–(3).

In this case, the feeding motor 12 is not necessarily a DC motor, but any other motor, such as a stepping motor or the like, may also be used.

The frictional member 50 functioning in the above-described manner acts as feeding-force providing means as the spring 14 and the feeding motor 12 in the above-described embodiments.

Figure 22:
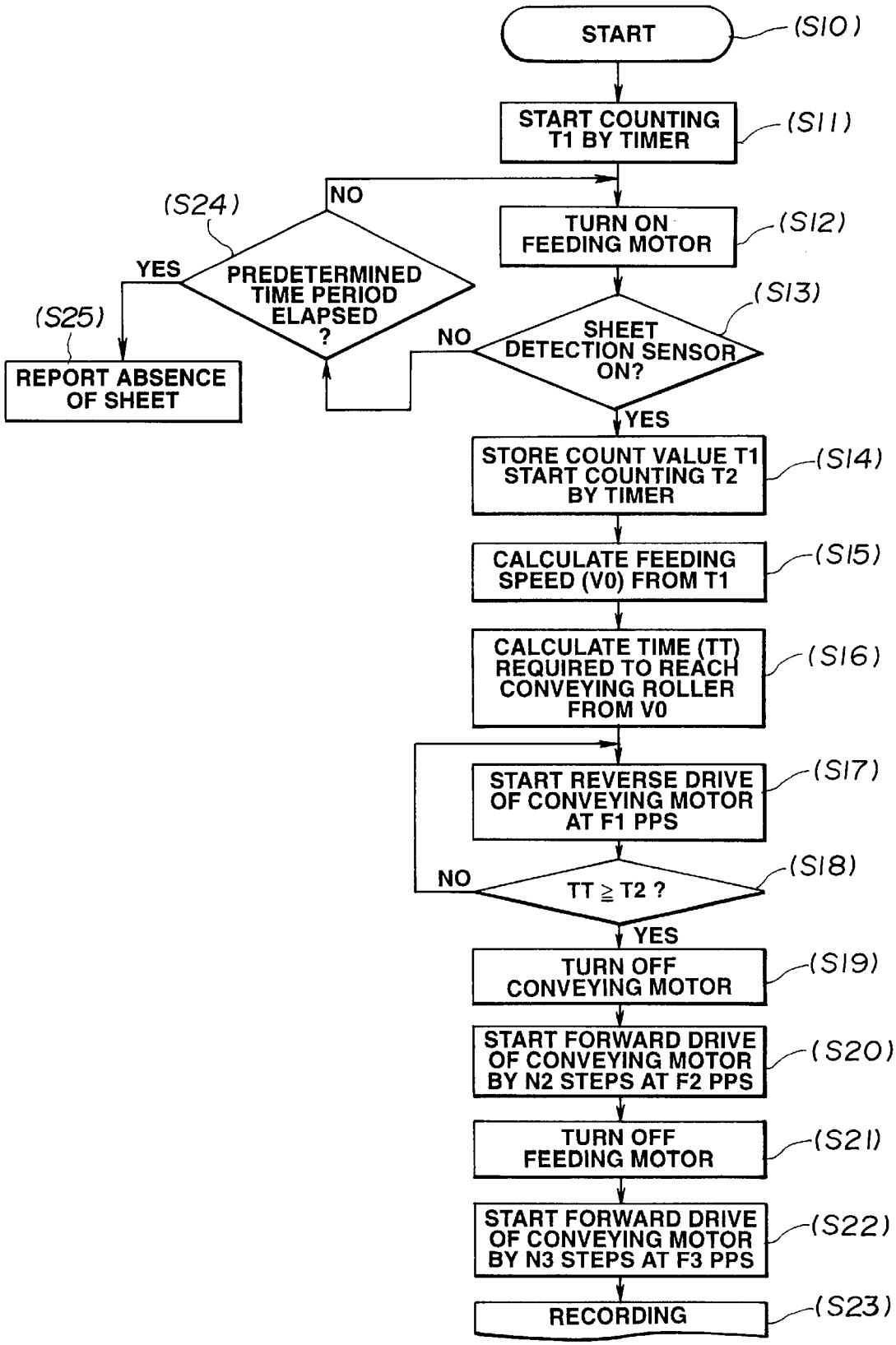
FIG. 22 is a flowchart illustrating another example of sheet-feeding control.

In addition to the operations of the sheet feeding device 6 and the recording unit 3 shown in FIG. 19, a control method as shown in FIG. 22 is preferable.

In FIG. 22, when a recording command has been received and a feeding operation has been started (step S10), counting of a time T1 by a timer is started (step S11), and the DC motor, serving as the feeding motor 12, is turned on (step S12) to feed the sheet 5.

The sheet 5 is fed until the leading edge of the sheet 5 passes through the sheet detection sensor 20. When the sheet 5 has been fed by the distance M1 shown in FIG. 16(*a*), the sheet detection sensor (PE sensor) 20 is turned on (step S13), and the counting of the time T1 by the timer is terminated and the count value T1 is stored, and counting of a time T2 by the timer is newly started (step S14). The feeding speed (V0) is calculated from the stored time T1 and the fed distance M1 (step S15). A DC motor is adopted as the motor for rotatably driving the sheet feeding roller 9. When a plurality of sheets are individually fed, the pressing force of the spring 14 for pressing the sheets 5 against the sheet feeding roller 9 changes depending on the number of remaining sheets, and the rotation speed of the sheet feeding roller 9 changes due to changes in the pressing force. The feeding speed is calculated in order to more precisely estimate the time when the leading edge of the sheet 5 reaches the conveying roller 21 of the recording unit 3.

When the feeding speed (V0) has been calculated, the time (TT) required for feeding the sheet 5 for the distance M2 shown in FIG. 16(*a*) is calculated from the value V0 (step S16). Thereafter, as in the case of FIG. 19, the (reverse) drive of the conveying motor in a direction opposite to the sheet-feeding direction at a predetermined speed F1 pps is started (step S17). The feeding motor 12 feeds the sheet 5 until the count value T2 by the timer equals the value TT. when the value T2 coincides with the value TT (step S18), the drive of the conveying motor of the recording unit 3 in the reverse direction is stopped (step S19), and the conveying motor is (forwardly) driven in the sheet-feeding direction by a predetermined amount N2 steps at a predetermined speed F2 pps (step S20). In the present embodiment, a stepping motor is adopted as the conveying motor. As described above, when switching the direction of revolution, or changing the revolution speed, as will be described below, of the conveying motor, the revolution of the conveying motor is stopped for 0.1 second.

When the conveying motor has been driven by the N2 steps, the drive of the feeding motor 12 is stopped (step S21). Thereafter, the conveying motor is (forwardly) driven by a predetermined amount N3 steps at a predetermined speed F3 pps (step S22) to feed the sheet 5 to the position to start recording. As in the case of FIG. 19, the sheet 5 is fed by the drive of the conveying motor and the feeding motor until the trailing edge of the sheet 5 is detached from the sheet feeding roller 9. Also as in the case of FIG. 19, the sheet 5 is fed to the conveying roller 21 rotatably driven in a direction opposite to the sheet-feeding direction, and both the conveying roller 21 rotatably driven in the sheet-feeding direction and the sheet feeding roller 9 are rotated.

If the PE sensor 20 is not turned on after the feeding motor 12 has been turned on in step S13, the feeding motor remains to be turned on if the time elapsed after the feeding motor 12 has been turned on is within a predetermined time period. After the lapse of the predetermined time period (step S24), it is determined that a sheet to be fed is absent, and the absence of the sheet is reported after stopping the feeding operation (step S25).

In the above-described embodiments, the sheet feeding roller 9 comprises the shaft 9*b* and the two roller units 9*a*, made of a hard rubber or the like, fitted on the shaft 9*b* at the predetermined interval. However, the configuration of the sheet feeding roller 9 is not limited to such a configuration, but may have the following configuration.

Figure 23A:
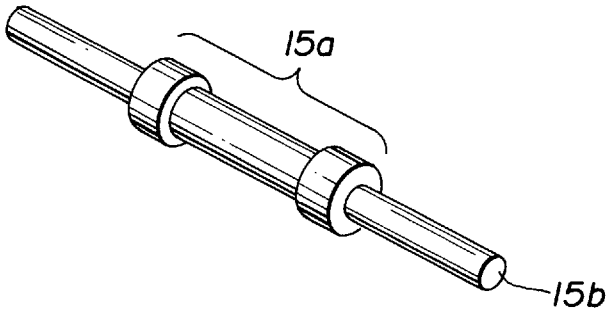
FIGS. 23(*a*) and 23(*b*) are perspective views illustrating other examples of the sheet feeding roller provided in the sheet feeding device.
Figure 23B:
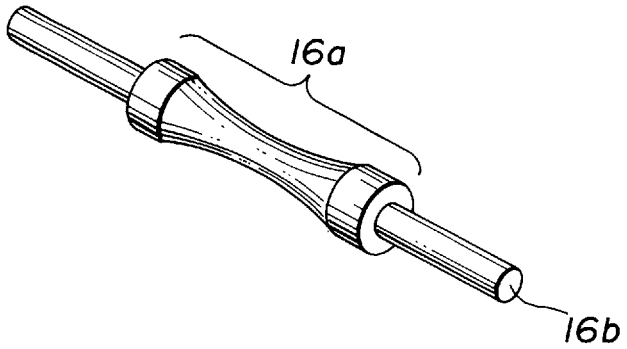

FIGS. 23(*a*) and 23(*b*) illustrate examples of the configuration of the sheet feeding roller 9. The sheet feeding roller 9 shown in FIG. 23(*a*) comprises a roller unit 15*a*, made of a hard rubber or the like and formed as one body so as to contact a sheet to be fed at two portions, fitted on a shaft 15*b*. As in the case of FIG. 23(*a*), in the sheet feeding roller 9 shown in FIG. 23(*b*), a roller unit 16*a* is formed as one body, and portions of the roller unit 16*a* in contact with a sheet to be fed are connected with a curved surface. In each of the roller units 15*a* and 16*a* shown in FIGS. 23(*a*) and 23(*b*), respectively, the diameter of a portion between portions in contact with a sheet to be fed is formed to be smaller than the diameter of the portions in contact with the sheet, so that the sheet feeding roller 9 contacts the sheet at two portions at a predetermined interval. In such configurations, since each of the roller units 15*a* and 16*a* is formed as one body, the interval between two portions in contact with the sheet can be precisely provided.

Figure 24:
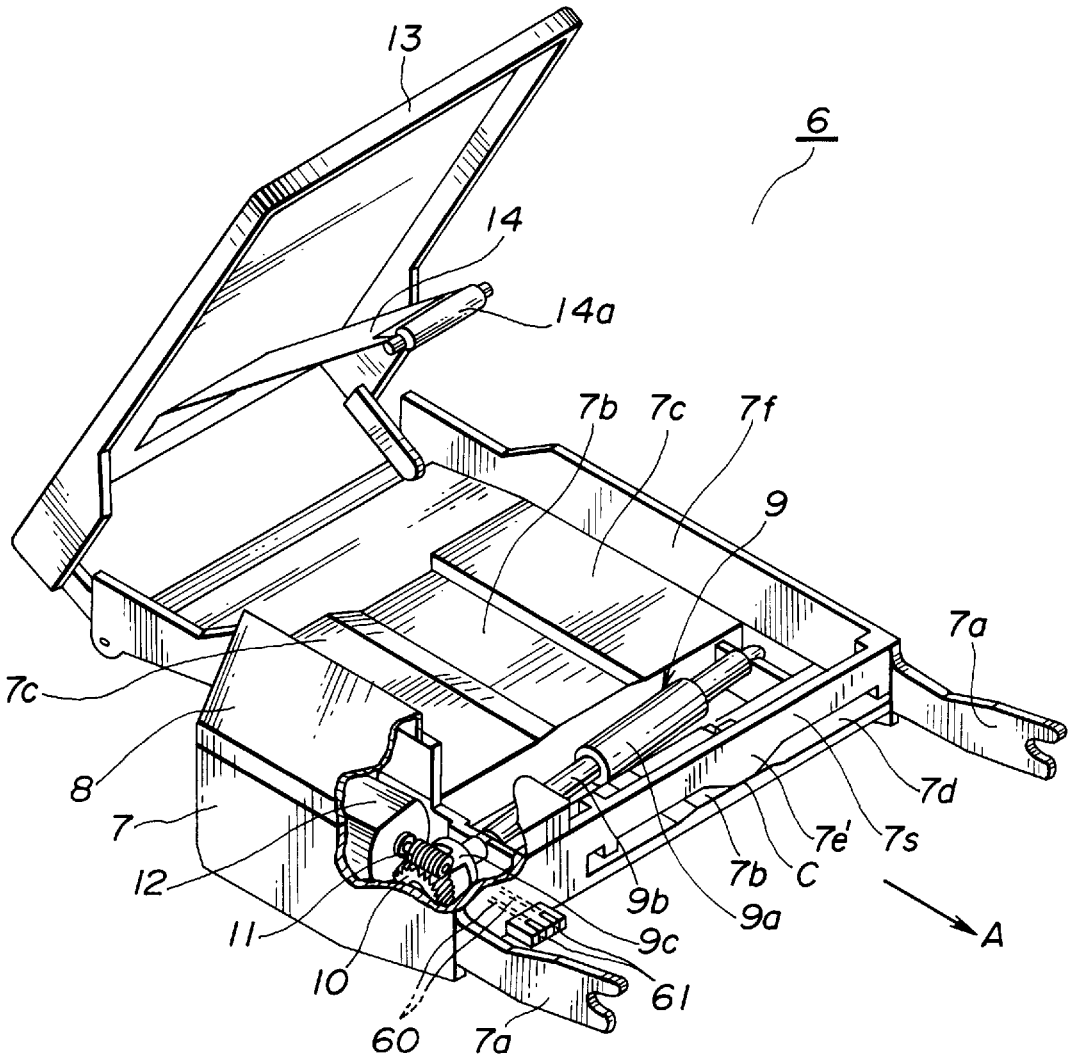
FIG. 24 is a perspective view illustrating the sheet feeding device having another separation mechanism.
Figure 25:
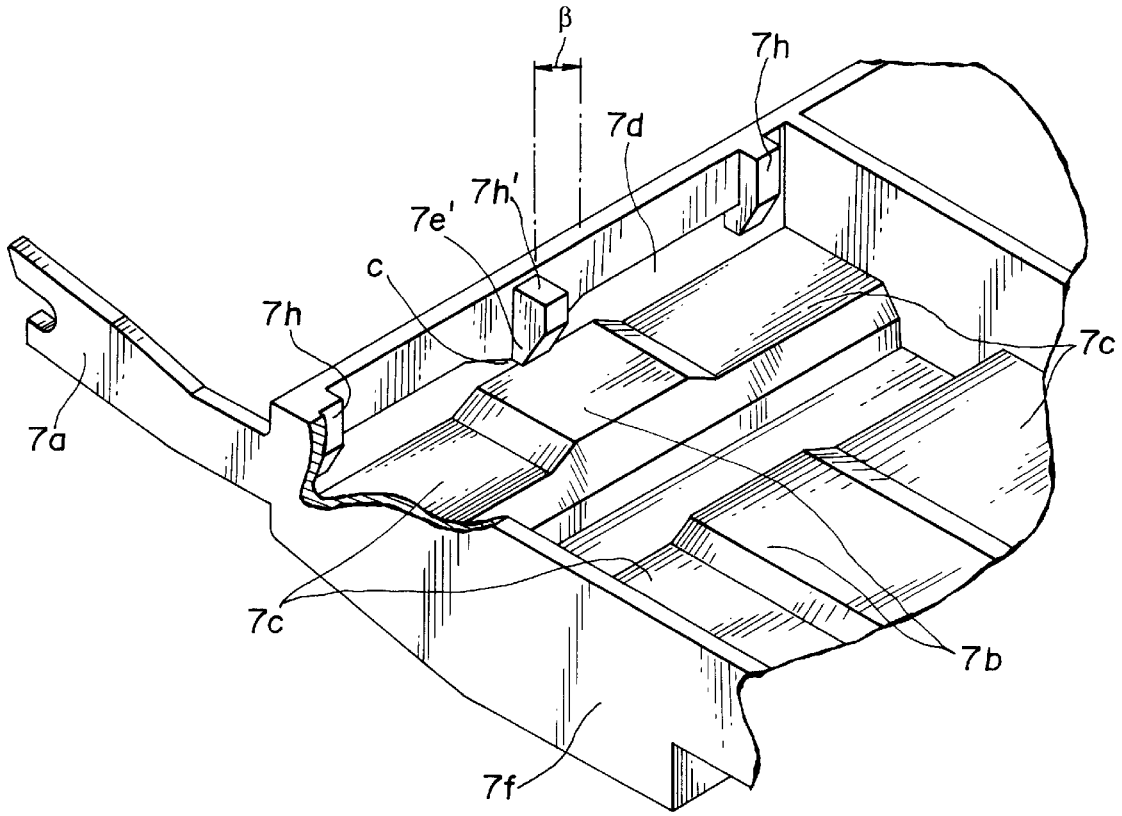
FIG. 25 is a perspective view illustrating the separation mechanism shown in FIG. 24.

Next, a description will be provided of another separation mechanism with reference to FIGS. 24 through 27(*d*). FIGS. 24 and 25 are perspective views illustrating a separation unit. In FIGS. 24 and 25, a gap member 7*e'* for forming a gap C for separation is provided in an aperture 7*d*. A guide member 7*h'*, provided in the vicinity of the gap member 7*e'*, for facilitating entrance of the leading edge of the sheet 5 into the gap C, and similar guide members 7*h*, provided at two sides of the aperture 7*d*, are formed as one body. The guide members 7*h* also function as regulation means for regulating the movement of the sheet 5 in the direction of the thickness at side portions of the sheet 5, and regulate floating of the sheet 5 at the above-described side plate 7*f*, providing the feeding reference position or the recording reference position.

When feeding the sheet 5 in a downwardly convex state as shown in FIG. 27(*b*) due to stocking conditions of the sheet 5 and environmental conditions, since the feeding direction of the sheet feeding roller 9 equals the direction B shown in FIG. 10, a side-end portion of the sheet 5 at the side of the side plate 7*f* moves in a direction opposite to the accommodating surface for the sheet 5, and, in some cases, floats. In such a case, if the amount of floating of the sheet 5 is great, the feeding position may become different from the recording position. However, since the regulation members 7*h* for regulating the movement of the sheet 5 in the direction of the thickness is provided, precise feeding can be performed.

As in the above-described embodiments, the gap member 7*e'* is provided at a position shifted from the center line of the sheet 5 in the lateral direction toward the side plate 7*f* by a distance β. That position is asymmetrical with respect to the center line of the sheet 5 in the lateral direction at an arbitrary position of the sheet placed in the sheet accommodating portion of the lower case 7. Hence, when the sheet 5 is fed again while turning the sheet 5 upside down, the portion of the sheet 5 in contact with the gap member 7*e'* differs from the initial portion.

Accordingly, even if an end portion of the sheet 5 is raised due to contact with the gap member 7*e'* when refeeding the sheet 5 while turning the sheet 5 upside down, the raised portion does not contact the gap member 7*e'*. As a result, the sheet 5 can be smoothly fed.

As described above, the gap member 7*e'* for separation is provided at a position where it does not contact two corner portions of the sheet 5. Gaps Ch formed by the guide members 7*h* are present at portions corresponding to the two corner portions of the sheet 5. However, as can be seen from FIGS. 26(*a*) and 26(*b*), since the gaps Ch are wider than the gap C for separation, the corner portions of the sheet 5 are not raised.

Although in the present embodiment, the guide members 7*h*, serving as the regulation means, are provided so as to regulate two side-end portions of the sheet 5, only a single guide member 7*h* may be provided at one side so as to regulate a side-end portion of the sheet 5 at the side of the side plate 7*f*, providing the feeding reference position.

Figure 26A:
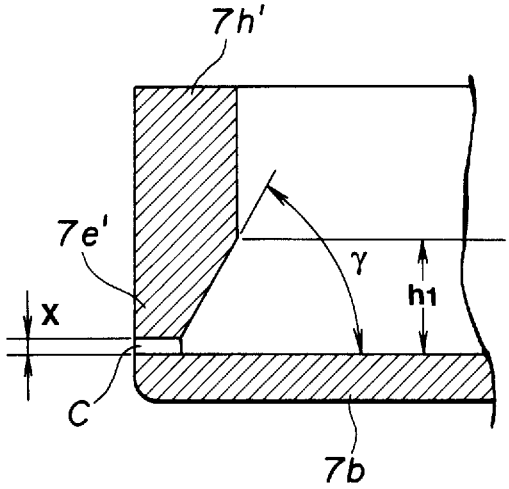
FIGS. 26(*a*) and 26(*b*) are cross-sectional views of the other separation mechanism shown in FIG. 24.
Figure 26B:
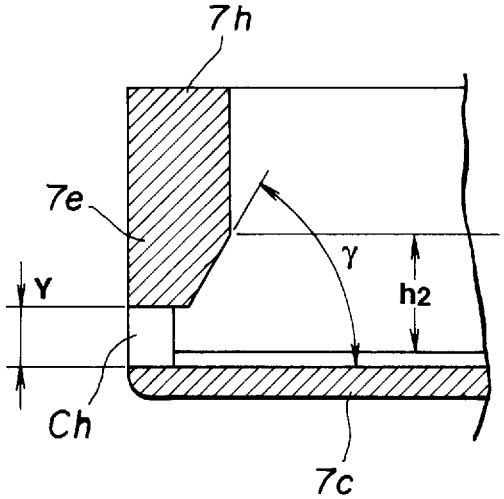
Figure 27A:
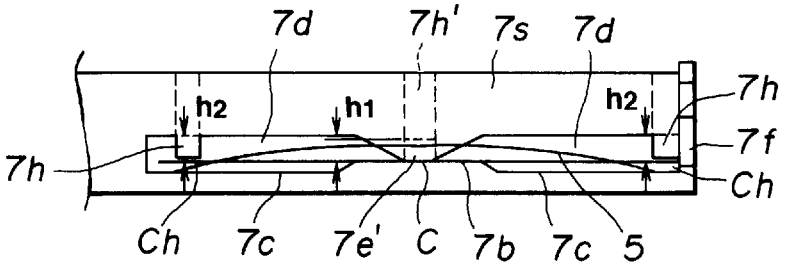
FIGS. 27(*a*) through 27(*d*) are front views of the separation mechanism shown in FIG. 24.
Figure 27B:
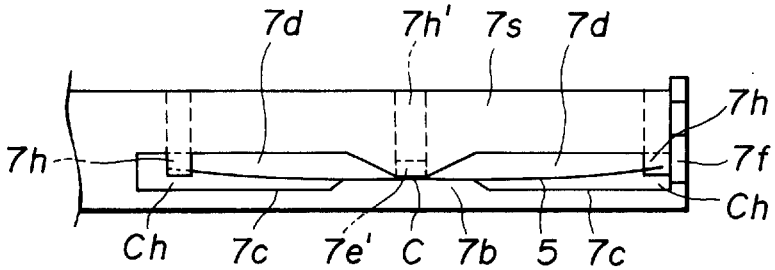
Figure 27C:
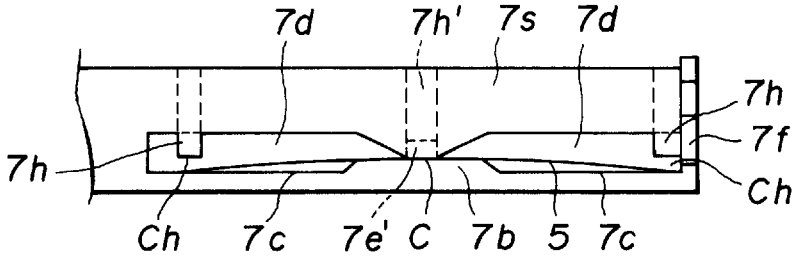
Figure 27D:
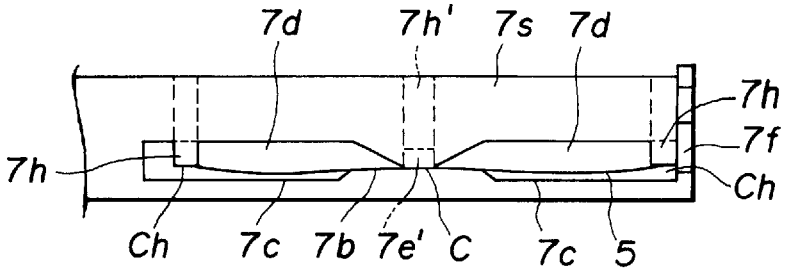

FIG. 26(*a*) is a cross-sectional view of the guide member 7*h'*. In FIG. 26(*a*), the gap C formed between the reference surface 7*b* and the gap member 7*e'* has a size X which is somewhat greater than the thickness of the sheet 5, in order to form a gap for separating the sheet 5. An inclined surface of the guide member 7*h'* is formed continuously and as one body with the gap member 7*e'* for separation at the gap C. The inclined surface makes an angle γ with the reference surface 7*b*. In the present embodiment, the angle γ is set to 60°.

In the present embodiment, surface formed on the inclined surface formed on the guide member 7*h'* is greater than the maximum estimated height of curl of the sheet 5 at a portion where the guide member 7*h'* contacts the sheet 5.

FIG. 26(*b*) is a cross-sectional view of the guide member 7*h*. In FIG. 26(*b*), the gap Ch between the guide member 7*h* and the supporting surface 7*c* has a value Y which is greater than the value X, and the angle made by the inclined surface of the guide member 7*h* and the supporting surface 7*c* has the same value γ as in the case of the guide member 7*h'*.

As in the case of the above-described height h1, the height h2 of the inclined surface formed on the guide member 7*h* is set to a value greater than the height of curl of the sheet 5 estimated at a portion where the sheet 5 contacts the guide member 7*h*, more specifically, the height of floating of the sheet 5 from the reference surface 7*c*. In the present embodiment, since the height of curl has a maximum value when a single sheet 5 is present, the height of floating of the sheet in such a case is adopted as the above-described height of floating. The height h2 of the inclined surface of the guide member 7*h* is set to a value greater than the above-described height h1, assuming that the height of curl of the sheet at the guide member 7*h* is greater than the value h1.

In the present embodiment, the angle γ made by the inclined surfaces of the guide members 7*h'* and 7*h*, and the reference surface 7*b* and the supporting surface 7*c*, respectively, equals 60°. If the angle γ is less than 30°, there is the possibility that the second sheet and/or subsequent sheets could enter the gap member 7*e'* together with the first sheet while the first sheet is being fed. Hence, it is desirable to make the angle γ equal to or greater than 30°. In the above-described embodiment, the inclined surfaces of the guide members 7*h'* and 7*h* make the same angle γ with the reference surface 7*b* and the supporting surface 7*c*, respectively. However, since the gap Ch between the guide member 7*h* and the supporting surface 7*c* is considerably greater than the thickness of the sheet 5, there is less possibility that the leading edges of the second and/or subsequent sheets will enter the gap Ch. Hence, the angle between the inclined surface of the guide member 7*h* and the supporting surface 7*c* may have a value different from the above-described value γ, for example, a value less than 30°. Although in the present embodiment, the heights of the inclined surfaces of the guide members 7*h'* and 7*h* are set so as to be h2>h1, any other relationship between the heights h1 and h2 may be adopted in accordance with the state of curl of the sheet 5, for example, as h1=h2.

FIGS. 27(*a*) through 27(*d*) illustrate the function of the above-described guide members 7*h'* and 7*h*. FIGS. 27(*a*) and 27(*b*) illustrate states before starting a feeding operation, as seen from the front side. The sheet 5 is not always flat depending on environmental conditions, such as the ambient temperature and himidity, conditions of use, and the like. Upwardly convex curl may be produced in the sheet 5 as shown in FIG. 27(*a*), or downwardly convex curl may be produced in the sheet 5 as shown in FIG. 27(*b*).

FIGS. 27(*c*) and 27(*d*) illustrate states in which the sheet 5 is passing through the above-described gaps.

As described above, the heights h1 and h2 of the inclined surfaces of the guide members 7*h'* and 7*h* are greater than the height of curl of the sheet 5 at contact portions with the guide members 7*h'* and 7*h*. Hence, even if the sheet 5 is curled, end portions of the sheet 5 contact the inclined surfaces of the guide members 7*h'* and 7*h*, and the sheet 5 is guided into the gaps C and Ch. The gap Ch between the guide member 7*h* and the supporting surface 7*c* is set to be greater than the gap C between the guide member 7*h'* and the reference surface 7*b*, and the height h2 is set to be equal to or greater than the height h1, in order to normally feed even the curled sheet 5.

The height of the supporting surface 7*c* is set to be lower than heights of the reference surface 7*b* and the upper surface of the sheet feeding roller 9 for the following reason. That is, when it is intended to press the sheet 5 having upwardly convex curve as shown in FIG. 27(*a*) against the sheet feeding roller 9 by the spring 14, a large force is needed for the spring 14 to press the sheet 5 to a flat state. The force needed for the spring 14 is reduced by lowering the supporting surface 7*c*.

Figure 28:
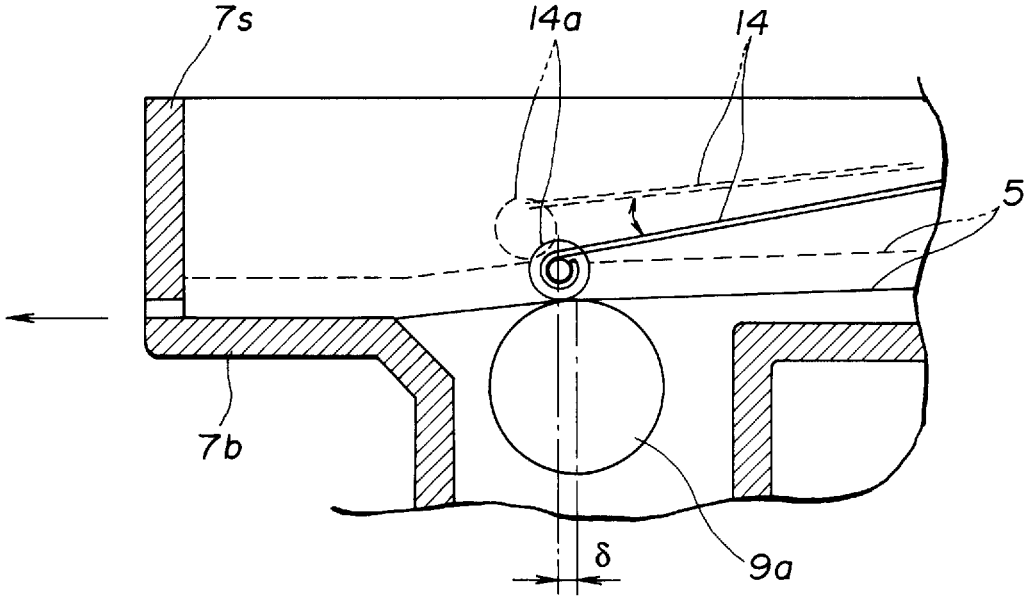
FIG. 28 is a cross-sectional view illustrating another example of the relationship between the sheet feeding roller and an elastic member of the sheet feeding device.

FIG. 28 is a cross-sectional view illustrating the positional relationship between the sheet feeding roller 9 and the spring 14, serving as contact means for contacting the sheet 5 to the sheet feeding roller 9. Portions where the spring 14 contacts and presses the roller units 9*a* of the sheet feeding roller 9 are always situated at a side downstream from the center of rotation of the sheet feeding roller 9 irrespective of the number of mounted sheets 5 to be separated and fed, and at a side more downstream by δ when only a single sheet is present. Thus, the sheet 5 is conveyed so as to always contact the reference surface 7*b* while being pressed at a side downstream from the sheet feeding roller 9. When the leading edge of the sheet 5 enters the gap formed by the gap member 7*e*, the leading edge of the sheet 5 is pressed so as not to float and easily enter the gap C.

Figure 29:
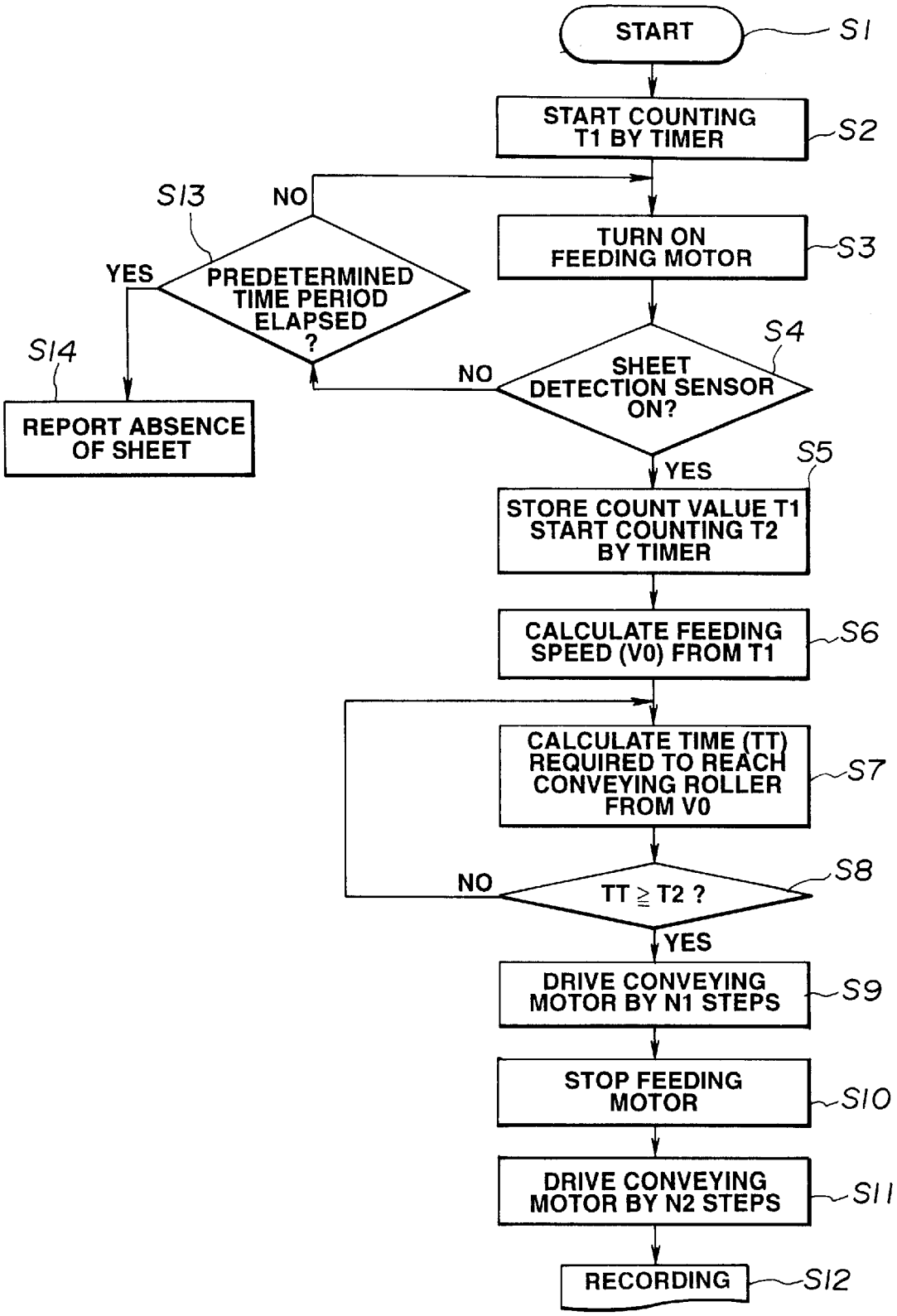
FIG. 29 is a flowchart illustrating still another example of sheet-feeding control.

Next, a description will be provided of another embodiment of control procedures for controlling the drive of the sheet feeding device 6 and the recording unit 3 with reference to a flowchart shown in FIG. 29.

In the above-described embodiment of the control procedures, oblique movement of the sheet 5 is prevented by contacting the sheet 5 to the conveying roller 21 by rotating the conveying roller 21 in the reverse direction. In the present embodiment, however, oblique movement of the sheet 5 is prevented by stopping the conveying roller 21.

In FIG. 29, when a recording command has been received and a feeding operation has been started (step S1), counting of a time T1 by a timer is started (step S2), and the DC motor, serving as the feeding motor 12, is turned on (step S3) to feed the sheet 5.

The sheet 5 is fed until the leading edge of the sheet 5 passes through the sheet detection sensor 20. When the sheet 5 has been fed by the distance M1 shown in FIG. 16(*a*), the sheet detection sensor (PE sensor) 20 is turned on (step S4), and the counting of the time T1 by the timer is terminated and the count value T1 is stored, and counting of a time T2 by the timer is newly started (step S5).

The feeding speed (V0) is calculated from the stored time T1 and the fed distance M1 (step S6). When a plurality of sheets 5 are set and are individually fed, the pressing force of the spring 14 for pressing the sheets 5 against the sheet feeding roller 9 changes depending on the number of remaining sheets, whereby a force necessary to rotatably drive the sheet feeding roller 9 changes. Since the DC motor is adopted as the sheet feeding motor 12, serving as a driving source to rotatably drive the sheet feeding motor 9, the rotation speed of the sheet feeding roller 9 changes as the force necessary to rotatably drive the sheet feeding roller 9 changes. Accordingly, by calculating the feeding speed (V0), the time when the leading edge of the sheet 5 reaches the conveying roller 21 of the recording unit 3 can be more precisely estimated.

When the feeding speed (V0) has been calculated, the time (TT) required for feeding the sheet 5 for the distance M2 shown in FIG. 16(*a*) is calculated from the value V0 (step S7). The feeding motor 12 feeds the sheet 5 until the count value T2 by the timer equals the value TT. When the value T2 coincides with the value TT (step S8), the conveying motor of the recording unit 3 is driven by a predetermined amount N1 steps (step S9). In the present embodiment, a stepping motor is adopted as the conveying motor.

When the conveying motor has been driven by N1 steps, the drive of the feeding motor 12 is stopped (step S10). Thereafter, the conveying motor is driven by a predetermined number of steps, N2 steps (step S11).

As described above, the feeding motor 12 is stopped after driving the conveying motor by N1 steps. If the feeding motor 12 is stopped immediately when the leading edge of the sheet 5 has reached the conveying roller 21, there is the possibility that the sheet 5 would not assuredly enter the conveying roller 21, thereby causing a failure in conveyance of the sheet 5. Accordingly, the sheet 5 is fed by the feeding motor 12 until the sheet assuredly enters the conveying roller 21. Then, the conveying motor is driven by N2 steps in order to convey the sheet 5 to the position to start recording, i.e., the distance M3 shown in FIG. 16(*b*). Accordingly, the relationship of M3=N1+N2 holds.

When the sheet 5 has been conveyed to the position to start recording in step S11, recording is actually started (step S12).

If the sheet detection sensor 20 is not turned on in step S4 after the feeding motor 12 has been turned on, the feeding motor 12 remains on if the time elapsed after the feeding motor 12 has been turned on is within a predetermined time period. After the lapse of the predetermined time period, if the sheet detection sensor is not turned on, the absence of the sheet is reported after stopping the feeding operation (step S14). In the present embodiment, the predetermined time period is set to 5 seconds. When the sheets 5 are not present, the spring 14 directly contacts the sheet feeding roller 9, as shown in FIG. 28. Accordingly, a roller 14*a* is provided at the distal end of the spring 14 so as not to damage the sheet feeding roller 9 and the spring 14.

In the above-described embodiments, only a single gap member 7*e* for separation has been illustrated. However, the number of the gap member 7*e* is not limited to only one. For example, as shown in FIGS. 30 and 31, the present invention can also be applied to a configuration in which two gap members 7*j* and 7*k* for separation are provided.

Figure 30:
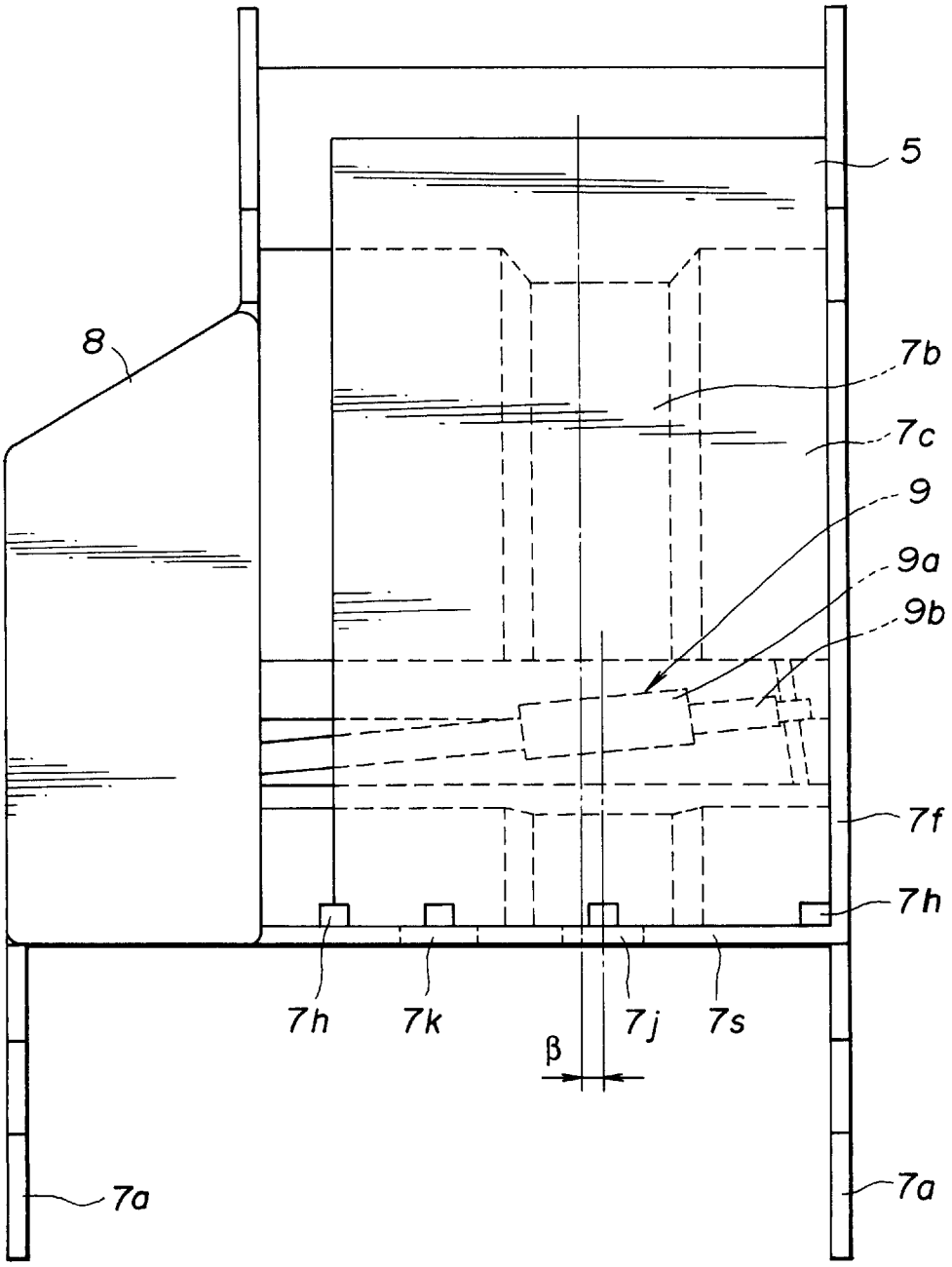
FIG. 30 is a plan view illustrating still another example of the separation mechanism.

In FIG. 30, roller units 9*a* of a sheet feeding roller 9, a reference surface 7*b* provided on a lower case 7 for accommodating sheets 5, a reference surface 7*c* provided at a position lower than the reference surface 7*b*, a side plate 7*f*, serving as a recording reference position, and a spring 14, serving as contact means, have the same configuration as in the above-described embodiments. A gap provided by the gap member 7*j* has the same configuration as the above-described gap formed by the gap member 7*e'*. That is, the gap is provided within a range where the sheet 5 is pressed by the spring 14 in the lateral direction, and is situated at a position shifted from the center line of the sheet 5, when a side of the sheet 5 is aligned along the side plate 7*f*, to the side plate 7*f* by a distance β. The other gap member 7*k* is situated at a position further from the side plate 7*f* than the gap member 7*j*.

Figure 31:
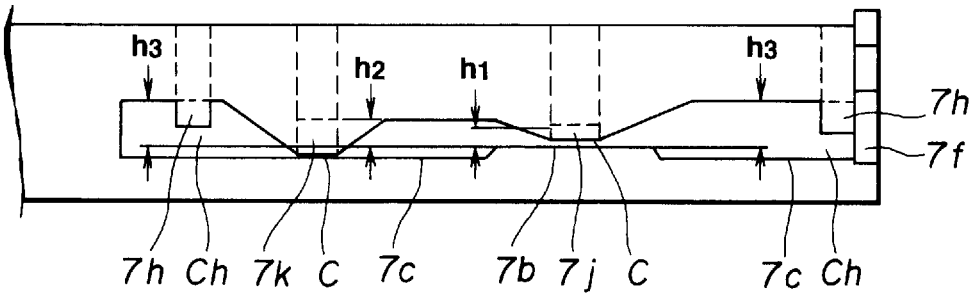
FIG. 31 is a front view of the separation mechanism shown in FIG. 30.

FIG. 31 is front view of the configuration shown in FIG. 30. The interval of a gap C formed between the gap member 7*j* and the reference surface 7*b* equals X shown in FIG. 26(*a*), and the interval of the gap C formed between the gap member 7*k* and the reference surface 7*c* also equals X.

As in the above-described embodiments, guide members for guiding the leading edge of the sheet 5 into the gap C are provided at the gap members 7*j* and 7*k* as one body therewith, and the heights of continuous inclined surfaces for guiding the sheets, provided on the guide members 7*j* and 7*k*, from the reference surfaces 7*b* and 7*c* equal h1 and h2, respectively. The heights h1 and h2 correspond to the estimated heights of curl of the sheet 5 at respective positions. In the present embodiment, the height of curl of a single sheet is adopted as the height of curl of the sheet 5. Since the sheet 5 is pressed by the spring 14 in the vicinity of the gap member 7*j*, the height of curl is estimated to be greater at the gap member 7*k*. Hence, it is arranged to be h2>h1.

Gaps having a height h3 from the reference surface 7*b* are provided at two sides of the gap members 7*j* and 7*k*, and regulation members 7*h* for regulating the direction of the thickness of the sheet 5 are provided. A continuous inclined surface for guiding the sheet 5 into the gap is provided on the regulation member 7*h*, the height of the inclined surface equals h3. The size of a gap Ch formed by the regulation member 7*h* equals Y shown in FIG. 26(*b*), which is greater than the size X of the gap formed by the gap members 7*k* and 7*j*. Since the height h3 is a gap at two end portions of the sheet 5, the height h3 is set to be greater than the height h2 of the inclined surface of the gap member 7*k* so as not to hinder the passage of the sheet 5 even if the sheet 5 is curled.

The heights h1 and h2 of the inclined surfaces and the height h3 of the gap at the two sides may be appropriately set in accordance with the kind of sheets to be used, environmental conditions and the like, for example, as h1=h2=h3.

When providing two gap members in the above-described manner, in general, the two gap members are worn differently depending on states of contact with sheets. Accordingly, even if one of the two members is worn earlier, the other is less worn, so that feeding of a plurality of sheets at a time can be prevented as much as possible.

Although in the above-described embodiments, the spring 14 is used as contact means for contacting the sheet 5 to the sheet feeding roller 9, the present invention can also be applied to a configuration in which contact means is fixedly provided and a pressing member is provided on the sheet feeding roller.

Figure 32:
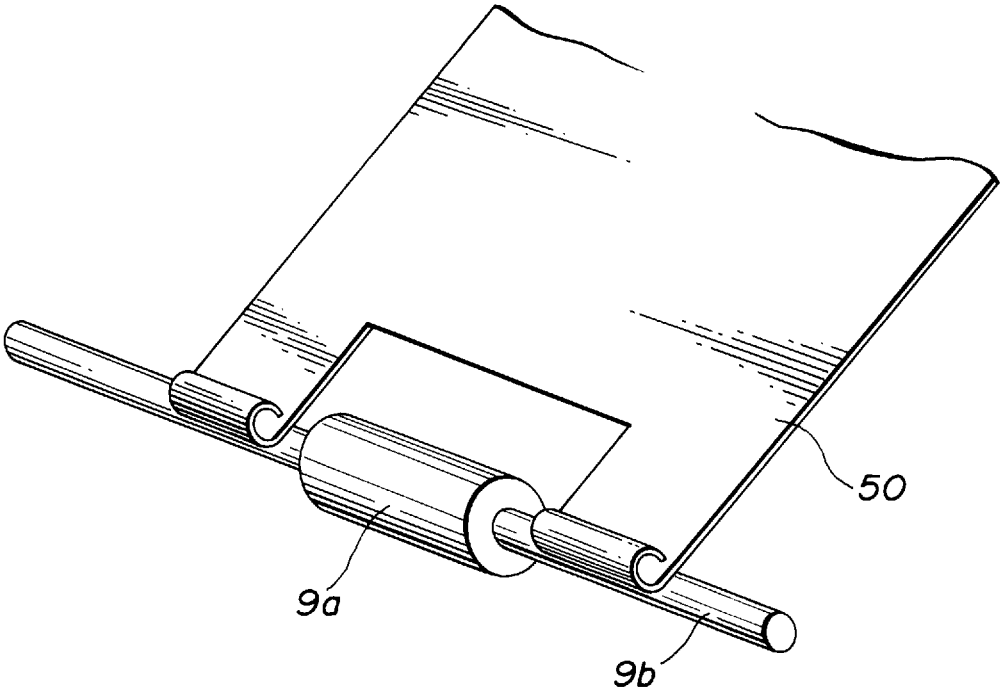
FIG. 32 is a perspective view illustrating another example of the elastic member for pressing a sheet against the sheet feeding roller.

Although in the above-described embodiments, a roller is provided on the elastic member and the sheet is pressed against the sheet feeding roller, the present invention can also be applied to a configuration in which, as shown in FIG. 32, an end portion of an elastic member 50 does not contact a sheet feeding roller. Also in this case, the contact position between the sheet and the elastic member is situated at a side downstream from the sheet feeding roller 9*a* in the sheet-feeding direction.

In the above-described embodiments, load when conveying the sheet 5 by the conveying roller 21 is reduced by driving the sheet feeding roller 9 until the trailing edge of the sheet 5 fed from the sheet feeding roller 9 passes through the sheet feeding roller 9. The same object can be achieved by using the following clutch mechanism.

Figure 33:
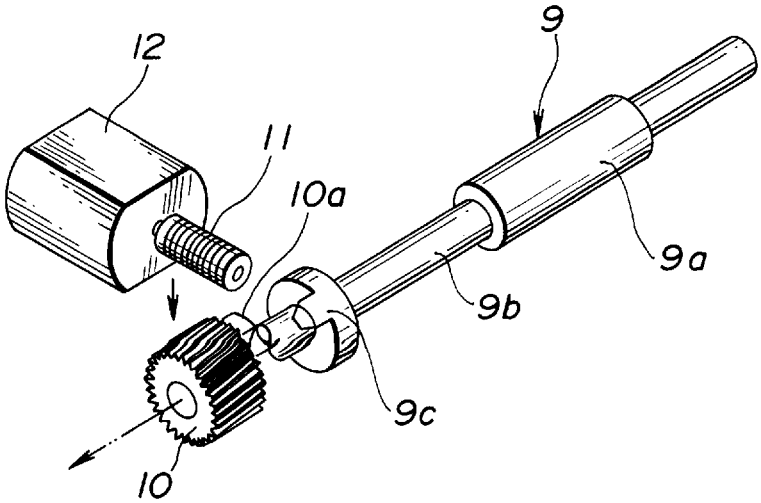
FIG. 33 is an exploded perspective view illustrating an example of a cluch mechanism provided between the sheet feeding roller and the motor.

The clutch mechanism will be described with reference to FIGS. 33 through 34(*b*). A projection 9*c* is formed at one end of the sheet feeding roller 9. When the shaft 9*b* of the sheet feeding roller 9 is inserted into a hole in the center of rotation of the gear 10, the projection 9*c* engages a projection 10*a* formed on the gear 10. The worm gear 11 mounted on the feeding motor 12 meshes with the gear 10.

Figure 34:
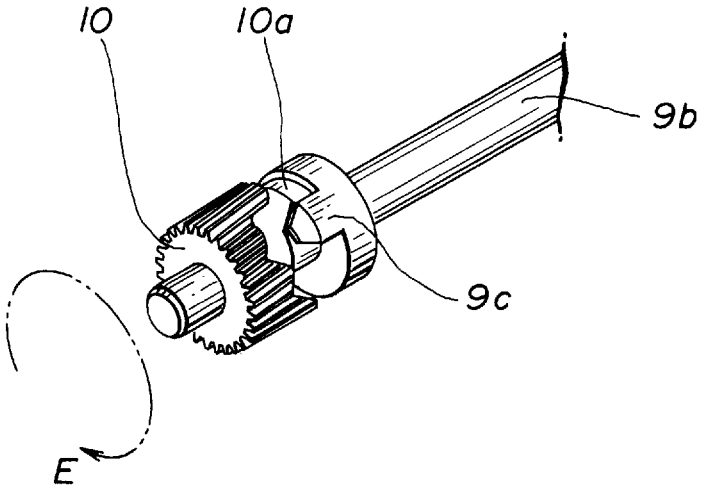
FIGS. 34(*a*) and 34(*b*) are perspective views illustrating the operation of the clutch mechanism shown in FIG. 33.
Figure 34:
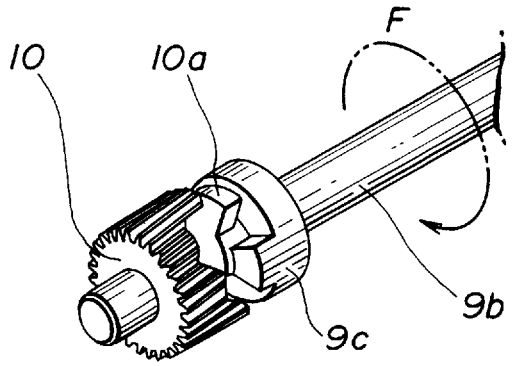

When the gear 10 is rotated by the feeding motor 12 in a direction E shown in FIG. 34(*a*), the projection 10*a* contacts the projection 9*c*, so that the sheet feeding roller 9 is rotated in the same direction E. When the sheet 5 has been fed from the sheet feeding device 6 to the recording unit 3 in this state, and the sheet 5 has reached the conveying roller 21 of the recording unit 3, the drive of the feeding motor 12 is stopped, and then the sheet 5 is conveyed by the conveying roller 21.

When the sheet 5 is conveyed by the conveying roller 21, the sheet feeding roller 9 is also rotated in a direction F shown in FIG. 34(*b*). When the sheet feeding roller 9 has been rotated in the direction F, the projection 9*c* separates from the projection 10*a*. Hence, the gear 10 stops rotation, and only the sheet feeding roller 9 rotates until the projection 9*c* again contacts the projection 10*a* after the sheet feeding roller 9 has completed about one rotation.

If the feeding motor 12 and the sheet feeding roller 9 are connected by the worm gear 11, the gear 10 cannot be rotated even if it is intended to rotate it from the side of the sheet feeding roller 9. Hence, the sheet 5 cannot be conveyed by the feeding roller 21 of the recording unit 3 unless the above-described clutch mechanism is used. Even if the worm gear 11 is not used, if the sheet feeding roller 9 is rotated at the same time the sheet 5 is conveyed by the conveying roller 21 of the recording unit 3, a body having large inertia including a gear train from the sheet feeding roller 9 to the feeding motor 12 must be rotated at the same time. Hence, a large conveying force is required for the conveying roller 21 of the recording unit 3. Accordingly, the above-described clutch mechanism is effective. Since the clutch mechanism of the present embodiment is obtained by the combination of the projections 9*c* and 10*a*, the configuration is simple, and therefore the production cost is low.

Although an ink-jet method is most suitable as the recording method of the recording unit 3, the present invention is not limited to this recording method, but any other recording method, such as a thermal transfer method, an impact transfer method, an electrophotographic method or the like may be used.

The individual components shown in outline or designated by blocks in the drawings are all well known in the electronic apparatus arts and their specific construction and operation are not critical to the operation or the best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An electronic apparatus comprising:

a main body having a keyboard and recording means;

a display unit rotatable relative to said main body;

an inlet for manually inserting a sheet to said recording means, said inlet being provided between said main body and said display unit, and near a rotational axis of said display unit; and a sheet feeding device, capable of continuously feeding sheets to the recording means via the inlet of said apparatus, said sheet feeding device mounted on the inlet so as to be detachable from the inlet at a position between said keyboard and said display unit when the display unit is rotated to an opened state.

2. An apparatus according to claim 1, wherein the inlet is disposed at an entrance to a conveying path, provided in the main body of said apparatus, for horizontally conveying a sheet, and wherein said sheet feeding device is mounted so as to substantially horizontally accommodate the sheets and horizontally feed the sheets toward the conveying path.

3. An apparatus according to claim 2, wherein said sheet feeding device comprises feeding rotation means below the accommodated sheets, and wherein the sheets are fed from the lowermost sheet by said feeding rotation means.

4. An apparatus according to claim 1, wherein said keyboard is operable when the display unit is rotated to an opened state, and wherein when said sheet feeding device is mounted, said sheet feeding device covers one portion of the keyboard and leaves a second portion of the keyboard for setting of feeding control of said sheet feeding device uncovered.

5. An apparatus according to any of claims 1 through 4, wherein said sheet feeding device comprises a driving source for feeding the sheets, and wherein sheet feeding is controlled by turning on/off electric power to said driving source using control means provided in the main body of said apparatus.

6. A sheet feeding device, adapted for continuously feeding sheets to an inlet of an electronic apparatus, said apparatus comprising: an inlet provided between a main body of the electronic apparatus and a display unit rotatable relative to the main body and near a rotation axis of said display unit, said sheet feeding device being mounted on the inlet so as to be detachable from the inlet between a keyboard on the main body and the display unit when the display unit is rotated to an opened state, said device comprising:

sheet supporting means for supporting sheets;

positioning means for positioning the sheets by regulating end portions of the sheets in the lateral direction;

feeding means obliquely disposed so as to generate a feeding force to feed the sheets supported by said sheet supporting means in the direction of said positioning means and a feeding force to feed the sheets in a predetermined direction different from the direction of said positioning means; and separation means for individually separating the sheets fed by said feeding means to the inlet of the electronic apparatus.

7. A device according to claim 6, wherein said separation means has an inclined surface for separating the sheets fed by said feeding means by contacting the sheets with and clearing said inclined surface.

8. A device according to claim 6, wherein said separation means has a gap capable of passing a single sheet to the inlet.

9. A device according to claim 8, further comprising a guide member, having an inclined surface formed thereon, for guiding the leading edge of one of the sheets into said gap.

10. A device according to claim 7 or 8, further comprising regulation members for regulating the degree of curvature of the leading edge of the sheet.

11. A device according to claim 7 or 8, wherein said feeding means comprises driving means disposed below the sheets supported by said sheet supporting means so as to face said feeding means, for providing a feeding force to a lowermost sheet to convey the sheet.

12. A device according to claim 11, further comprising an openable/closable cover for covering said sheet supporting means, wherein said driving means drives the lowermost sheet in accordance with opening/closing of said cover.

13. A device according to claim 6, wherein in the lateral direction of the supported sheets, a central portion of said sheet supporting means is formed to be higher than two end portions thereof, and wherein said feeding means comprises a pair of feeding rotation members disposed so as to cross over the central portion of said sheet supporting means.

14. A device according to claim 6, further comprising:

conveying means, which the one of the sheets fed from said feeding means contacts, for correcting oblique movement of the sheet; and feeding-force setting means for setting a feeding force of said feeding means so that the one of the sheets is not bent when the one of the sheet contacts said conveying means.

15. A device according to claim 14, wherein said feeding-force setting means comprises an elastic member for exerting pressure on the one of the sheets to contact said feeding means, and wherein the elastic force of said elastic member is set so as to satisfy the following relational expressions:

$$FB<FK,$$

$$FN_{min}<FK<FN_{max},$$

and $$FK<FZ,$$

where $FN_{max}$ and $FN_{min}$ are maximum and minimum values, respectively, of a force necessary to push the one of the sheets against said conveying means, FB is a force necessary to separate the sheets by said separation means, FZ is a buckling force necessary to buckle the one of the sheets, and FK is a force to feed the one of the sheets by said feeding means.

16. A device according to claim 14, wherein said feeding-force setting means comprises a driving source for driving said feeding means, and wherein the driving force of said driving source is set so as to satisfy the following relational expressions:

$$TM<TS,$$

$$FB<FK,$$

and $$FN_{min}<FK<FN_{max},$$

where TM is the starting torque of the driving source, TS is the buckling force of the one of the sheets converted into the value of the torque, $FN_{max}$ and $FN_{min}$ are maximum and minimum values, respectively, of the force necessary to push the sheet against said conveying means, FB is the force necessary to separate the sheets by said separation means, and FK is the force necessary to feed the one of the sheets by said feeding means.

17. A device according to claim 14, wherein said feeding-force setting means comprises a torque limiter for connecting said feeding means to a driving source for driving said feeding means, and wherein the limit value of said torque limiter is set so as to satisfy the following relational expressions:

$$FB<FK,$$

$$FN_{min}<FK<FN_{max},$$

and $$FK<FZ,$$

where $FN_{max}$ and $FN_{min}$ are maximum and minimum values, respectively, of the force necessary to push the one of the sheets agaist said conveying means, FB is the force necessary to separate the sheets by said separation means, FB is the buckling force of the one of the sheets, and FK is the force to feed the one of the sheets by said feeding means.

18. A device according to any one of claims 14 through 17, wherein oblique movement of the one of the sheets is corrected by driving said conveying means in the reverse direction with the sheet contacting said conveying means.

19. A device according to claim 6, further comprising control means for driving said feeding means until the trailing edge of one of the sheets fed by said feeding means passes through said feeding means even after said conveying means disposed on the main body of the electronic apparatus begins conveying the one of the sheets.

20. A device according to claim 19, wherein said control means is provided at a side of the main body of the electronic apparatus, and wherein a feeding operation of said feeding means is controlled by turning on/off electric power to a motor for driving said feeding means.

21. A device according to claim 19, further comprising detection means, provided between said feeding means and said conveying means, for detecting a sheet, wherein the feeding speed of the sheet is calculated based on a time period from a start of feeding by said feeding means until said detection means detects the sheet, wherein a time when the sheet reaches said conveying means is calculated based on the feeding speed, and wherein said control means controls the operations of said feeding means and said conveying means based on the calculated time when the sheet reaches the conveying means.

22. An apparatus according to claim 1, wherein said recording means uses an ink jet method to record on the sheet fed into the inlet of said apparatus.

23. A device according to claim 6, further comprising a recording unit using an ink jet method to record on the sheets fed into the inlet of said apparatus.

24. A device according to claim 19, further comprising a recording unit using an ink jet method to record on the sheets fed into the inlet of said apparatus.

25. An apparatus according to claim 1, wherein said sheet feeding device has sheet supporting means for supporting sheets and sheet feeding means for feeding out the sheets form said sheet supporting means to the inlet of the electronic apparatus.

* * * * *

UNITED STATES PATENT AND TRADEMARK OFFICE

CERTIFICATE OF CORRECTION

PATENT NO. : 5,816,723

DATED : October 6, 1998

INVENTORS : SEIJI TAKAHASHI, ET AL.

It is certified that error appears in the above-identified patent and that said Letters Patent is hereby corrected as shown below:

COLUMN 5,
Line 43, "unit," should read --unit),--; and
Line 53, "CPU unit" should read --CPU--.

COLUMN 8,
Line 64, "hi" should read --h1--.

COLUMN 18,
Line 9, "has" should read --have--; and
Line 17, "surface formed on" should read --the height h1 of--.

COLUMN 20,
Line 21, "N1 step" should read --of N1 steps--.

COLUMN 23,
Line 37, "an inlet of" should be deleted.

UNITED STATES PATENT AND TRADEMARK OFFICE

CERTIFICATE OF CORRECTION

PATENT NO. : 5,816,723

DATED : October 6, 1998

INVENTORS : SEIJI TAKAHASHI, ET AL.

It is certified that error appears in the above-identified patent and that said Letters Patent is hereby corrected as shown below:

COLUMN 26,
Line 28, "form" should read --from--.

Signed and Sealed this

Twenty-fifth Day of May, 1999

*Attest:*

Q. TODD DICKINSON

*Attesting Officer*

*Acting Commissioner of Patents and Trademarks*